US007911422B2

(12) United States Patent
Yoon et al.

(10) Patent No.: US 7,911,422 B2
(45) Date of Patent: Mar. 22, 2011

(54) METHOD AND APPARATUS FOR DRIVING PLASMA DISPLAY PANEL USING SELECTIVE WRITING AND ERASING

(75) Inventors: Sang Jin Yoon, Kyoungsangbuk-do (KR); Seong Ho Kang, Daegu-kwanyeokshi (KR)

(73) Assignee: LG Electronics Inc., Seoul (KR)

( * ) Notice: Subject to any disclaimer, the term of this patent is extended or adjusted under 35 U.S.C. 154(b) by 822 days.

(21) Appl. No.: 11/896,638

(22) Filed: Sep. 4, 2007

(65) Prior Publication Data

US 2007/0296647 A1 Dec. 27, 2007

Related U.S. Application Data

(63) Continuation of application No. 10/740,503, filed on Dec. 22, 2003, now Pat. No. 7,271,782.

(30) Foreign Application Priority Data

Dec. 23, 2002 (KR) ..... 10-2002-082576

(51) Int. Cl.
*G09G 3/28* (2006.01)

(52) U.S. Cl. ..... 345/68; 345/60

(58) Field of Classification Search ..... 345/60–68; 315/169.1, 169.2, 169.4
See application file for complete search history.

(56) References Cited

U.S. PATENT DOCUMENTS

| | | | | |
|---|---|---|---|---|
| 6,292,159 | B1 | 9/2001 | Someya et al. | |
| 6,653,795 | B2 | 11/2003 | Kang et al. | |
| 6,653,994 | B2 * | 11/2003 | Takeda et al. | 345/60 |
| 6,768,479 | B2 | 7/2004 | Nakamura | |
| 6,954,188 | B2 * | 10/2005 | Seo et al. | 345/66 |
| 2002/0097003 | A1 * | 7/2002 | Takamori et al. | 315/169.4 |
| 2002/0190930 | A1 * | 12/2002 | Shiizaki et al. | 345/63 |

FOREIGN PATENT DOCUMENTS

| | | |
|---|---|---|
| JP | 2000-267627 | 9/2000 |
| KR | 2002-66274 | 8/2002 |

OTHER PUBLICATIONS

KR Office Action (Nov. 30, 2004).

* cited by examiner

*Primary Examiner* — Kevin M Nguyen
(74) *Attorney, Agent, or Firm* — KED & Associates, LLP

(57) ABSTRACT

A plasma display driving method and apparatus for stabilizing an initialization upon selective erasing in a case of simultaneously performing a selective writing and a selective erasing is disclosed. In the method and apparatus, at least one selective writing sub-field for selecting on-cells using a writing discharge is arranged within a portion of one frame period, and at least one selective erasing sub-field for selecting off-cells from the on-cells using an erase discharge is arranged within the remaining interval of one frame period other than a time period arranged with the selective writing sub-field. A normal sustaining pulse is applied to the selected on-cells to sustain a discharge of the on-cells, and an initialization pulse having at least one of a pulse width and a voltage level set to be larger than the normal sustaining pulse is applied prior to said selective erasing sub-fields.

31 Claims, 12 Drawing Sheets

METHOD AND APPARATUS FOR DRIVING PLASMA DISPLAY PANEL USING SELECTIVE WRITING AND ERASING

This application is a Continuation of U.S. application Ser. No. 10/740,503, filed Dec. 22, 2003, now U.S. Pat. No. 7,271,782 which claims the benefit of the Korean Application No. 82576/2002 filed Dec. 23, 2002, the subject matter which are hereby incorporated by reference.

BACKGROUND OF THE INVENTION

1. Field of the Invention

This invention relates to a technique for driving a plasma display, and more particularly to a plasma display driving method and apparatus that is adaptive for driving the plasma display at a high speed as well as improving a contrast.

2. Description of the Related Art

Generally, a plasma display radiates a phosphorus material using an ultraviolet ray generated upon discharge of a gas such as He+Xe or Ne+Xe, to thereby display a picture including characters or graphics. Such a plasma display is easy to be made into a thin-film and large-dimension type. Moreover, the plasma display provides a very improved picture quality owing to a recent technical development.

Particularly, a three-electrode, alternating current (AC) surface-discharge type plasma display has advantages of a low-voltage driving and a long life in that it can lower a voltage required for a discharge using wall charges accumulated on the surface thereof during the discharge and protect the electrodes from a sputtering caused by the discharge.

Referring to FIG. 1, a discharge cell of the three-electrode, AC surface-discharge plasma display includes a scan electrode 30Y and a sustain electrode 30Z formed on an upper substrate 10, and an address electrode 20X formed on a lower substrate 18.

The scan electrode 30Y and the sustain electrode 30Z includes a transparent electrode 12Y or 12Z, and a metal bus electrode 13Y or 13Z having a smaller line width than the transparent electrode 12Y or 12Z and provided at one edge of the transparent electrode, respectively. The transparent electrodes 12Y and 12Z are formed from indium-tin-oxide (ITO) on the upper substrate 10. The metal bus electrodes 13Y and 13Z are formed on the transparent electrodes 12Y and 12Z from a metal such as chrome (Cr) to thereby reduce a voltage drop caused by the transparent electrodes 12Y and 12Z having a high resistance.

On the upper substrate 10 provided with the scan electrode 30Y and the sustain electrode 30Z, an upper dielectric layer 14 and a protective film 16 are disposed. Wall charges generated upon plasma discharge are accumulated onto the upper dielectric layer 14. The protective film 16 protects the upper dielectric layer 14 from a sputtering of the charged particles generated during the plasma discharge and improves the emission efficiency of secondary electrons. This protective film 16 is usually made from MgO.

The address electrode 20X is formed in a direction crossing the scan electrode 30Y and the sustain electrode 30Z. A lower dielectric layer 22 and barrier ribs 24 are formed on the lower substrate 18 provided with the address electrode 20X. A phosphorous material layer 26 is formed on the surfaces of the lower dielectric layer 22 and the barrier ribs 24. The barrier ribs 24 are formed in parallel to the address electrode 20X to divide the discharge cells physically, and prevents an ultraviolet ray and a visible light generated by the discharge from being leaked into adjacent discharge cells.

The phosphorous material layer 26 is excited and radiated by an ultraviolet ray generated upon discharge to produce any one of red, green and blue color visible lights. An inactive mixture gas, such as He+Xe, Ne+Xe or He+Ne+Xe, for a gas discharge is injected into a discharge space defined between the upper/lower substrate 10 and 18 and the barrier ribs 24.

Such a three-electrode AC surface-discharge plasma display drives one frame, which is divided into various sub-fields having a different emission frequency, so as to realize gray levels of a picture. Each sub-field is again divided into a reset period for uniformly causing a discharge, an address period for selecting the discharge cell and a sustain period for realizing the gray levels depending on the discharge frequency. If it is intended to display a picture of 256 gray levels, then a frame period equal to 1/60 second (i.e. 16.67 msec) is divided into 8 sub-fields SF1 to SF8 as shown in FIG. 2. Each of the 8 sub-field SF1 to SF8 is divided into a reset period, an address period and a sustain period. The reset period and the address period of each sub-field are equal every sub-field, whereas the sustain period and the discharge frequency are increased at a ratio of $2^n$ (wherein n=0, 1, 2, 3, 4, 5, 6 and 7) at each sub-field. As the sustain period at each sub-field is differentiated as mentioned above, a gray level of a picture can be implemented.

Such a plasma display driving method is largely classified into a selective writing system and a selective erasing system depending on whether or not there is an light-emission of the discharge cell selected by the address discharge.

The selective writing system turns on the discharge cells selected in the address period after turning off the entire field in the reset period. In the sustain period, a discharge of the discharge cells selected by the address discharge is sustained to thereby display a picture.

In the selective writing system, a scanning pulse applied to the scan electrode 30Y must be set to have a relatively large pulse width, thereby forming sufficient wall charges within the discharge cell.

If the plasma display has a resolution of VGA (video graphics array) class, it has total 480 scanning lines. Accordingly, in the selective writing system, an address period within one frame requires total 11.52 ms when one frame period (i.e., 16.67 ms) includes 8 sub-fields. On the other hand, a sustain period is assigned to 3.05 ms in consideration of a vertical synchronizing signal Vsync. Herein, assuming that a pulse width of the scanning pulse should be 3 μs, the address period is calculated by 3 μs (a pulse width of the scanning pulse)× 480 lines×8 (the number of sub-fields) per frame. The sustain period is a time value (i.e., 16.67 ms−11.52 ms−0.3 ms−1 ms−0.8 ms) obtained by subtracting an address period of 11.52 ms, once reset period of 0.3 ms, an erase period of 100 μs×8 sub-fields and an extra time of the vertical synchronizing signal Vsync of 1 ms from one frame period of 16.67 ms.

The plasma display may generate a pseudo contour noise from a moving picture because of its characteristic realizing the gray levels of the picture by a combination of sub-fields. If the pseudo contour noise is generated, then a pseudo contour emerges on the screen to thereby deteriorate a picture display quality. For instance, if the screen is moved to the left after the left half of the screen was displayed by a gray level value of 128 and the right half of the screen was displayed by a gray level value of 127, then a peak white, that is, a white stripe emerges at a boundary portion between the gray level values 128 and 127. To the contrary, if the screen is moved to the right after the left half thereof was displayed by a gray level value of 128 and the right half thereof was displayed by a gray level value of 127, then a black level, that is, a black stripe emerges on at a boundary portion between the gray level values 127 and 128.

In order to eliminate a pseudo contour noise of a moving picture, there has been suggested a scheme of dividing one sub-field to add one or two sub-fields, a scheme of re-arranging the sequence of sub-fields, a scheme of adding the sub-fields and re-arranging the sequence of sub-fields, and an error diffusion method, etc. However, in the selective writing system, if the sub-fields are added so as to eliminate a pseudo contour noise of a moving picture, then the sustain period becomes insufficient or fails to be assigned. For instance, in the selective writing system, if two sub-fields of the 8 sub-fields are divided such that one frame includes 10 sub-fields, then the display period, that is, the sustain period becomes absolutely insufficient as follows. If one frame includes 10 sub-fields, then the address period becomes 14.4 ms, which is calculated by 3 μs (a pulse width of the scanning pulse)×480 lines×10 (the number of sub-fields) per frame. On the other hand, the sustain period becomes −0.03 ms (i.e., 16.67 ms−14.4 ms−0.3 ms−1 ms−1 ms), which is a time value obtained by subtracting an address period of 14.4 ms, once reset period of 0.3 ms, an erase period of 100 μs×10 sub-fields and an extra time of the vertical synchronizing signal Vsync of 1 ms from one frame period of 16.67 ms.

In such a selective writing system, a sustain period of about 3 ms can be assured when one frame consists of 8 sub-fields, whereas it becomes impossible to assure a time for the sustain period when one frame consists of 10 sub-fields. In order to overcome this problem, there has been suggested a scheme of making a divisional driving of one field. However, such a scheme raises another problem of a rise of manufacturing cost because it requires an addition of driver IC's.

A contrast characteristic of the selective writing system is as follows. In the selective writing system, when one frame consists of 8 sub-fields, a light of about 300 cd/m$^2$ corresponding to a brightness of the peak white is produced if a field continues to be turned on in the entire sustain period of 3.05 ms. On the other hand, if the field is sustained in a state of being turned on only in once reset period and being turned off in the remaining interval within one frame, then a light of about 0.7 cd/m$^2$ corresponding to the black is produced. Accordingly, a darkroom contrast ratio in the selective writing system has a level of 430:1.

The selective erasing system makes a writing discharge of the entire field in the reset period and thereafter turns off the discharge cells selected in the address period. Then, in the sustain period, only the discharge cells having not selected by the address discharge are subject to a sustain discharge to thereby display a picture.

In the selective erasing system, a selective erasing data pulse is applied to the address electrode 20X so that it can erase wall charges and space charges of the discharge cells selected during the address discharge. At the same time, a scanning pulse synchronized with the selective erasing data pulse is applied to the scan electrode 30Y. A pulse width of the data pulse and the scanning pulse for causing an erasing address discharge in the selective erasing system may be narrower than that of the data pulse and the scanning pulse in the selective writing system.

In the selective writing system, if the plasma display has a resolution of VGA (video graphics array) class, then an address period within one frame requires only total 3.84 ms when one frame period (i.e., 16.67 ms) consists of 8 sub-fields. On the other hand, a sustain period can be sufficiently assigned to about 10.73 ms in consideration of a vertical synchronizing signal Vsync. Herein, assuming that a pulse width of the scanning pulse should be 1 μs, the address period is calculated by 1 μs (a pulse width of the scanning pulse)× 480 lines×8 (the number of sub-fields) per frame. The sustain period is a time value (i.e., 16.67 ms−3.84 ms−0.3 ms−1 ms−0.8 ms) obtained by subtracting an address period of 3.84 ms, once reset period of 0.3 ms, and an extra time of the vertical synchronizing signal Vsync of 1 ms and an entire writing time of 100 μs×8 sub-fields from one frame period of 16.67 ms. In such a selective erasing system, since the address period is small, the sustain period as a display period can be assured even though the number of sub-fields is increased. If the number of sub-fields SF1 to SF10 within one frame is increased into ten as shown in FIG. 3, then the address period becomes 4.8 ms, which is calculated by 1 μs (a pulse width of the scanning pulse)×480 lines×10 (the number of sub-fields) per frame. On the other hand, the sustain period becomes 9.57 ms, which is a time value (i.e., 16.67 ms−4.8 ms−0.3 ms−1 ms−1 ms) obtained by subtracting an address period of 4.8 ms, once reset period of 0.3 ms, an extra time of the vertical synchronizing signal Vsync of 1 ms and the entire writing time of 100 μs×10 sub-fields from one frame period of 16.67 ms. Accordingly, the selective erasing system can assure a sustain period three times longer than the above-mentioned selective writing system having 8 sub-fields even though the number of sub-fields is enlarged into ten, so that it can realize a bright picture with 256 gray levels.

However, the selective erasing system has a disadvantage of low contrast because the entire field is turned on in the entire writing interval that is a non-display interval.

In the selective erasing system, if the entire field continues to be turned on in the sustain period of 9.57 ms within one frame consisting of 10 sub-fields SF1 to SF10 as shown in FIG. 3, then a light of about 950 cd/m$^2$ corresponding to a brightness of the peak white is produced. A brightness corresponding to the black is 15.7 cd/m$^2$, which is a brightness value of 0.7 cd/m$^2$ generated in once reset period plus 1.5 cd/m$^2$×10 sub-fields generated in the entire writing interval within one frame. Accordingly, since a darkroom contrast ratio in the selective erasing system is equal to a level of 950:15.7=60:1 when one frame consists of 10 sub-fields SF1 to SF10, the selective erasing system has a low contrast. As a result, a driving method using the selective erasing system provides a bright field owing to an assurance of sufficient sustain period, but fails to provide a clear field and a feeling of blurred picture due to a poor contrast.

In order to overcome a problem caused by such a poor contrast, there has been suggested a scheme of making an entire writing only once per frame and taking out the unnecessary discharge cells every sub-field SF1 to SF10. However, this scheme has a problem of poor picture quality in that, since the discharge cell can be selected at the next sub-field only when the previous sub-field has been necessarily turned on, the number of gray levels becomes merely the number of sub-fields plus one. In other words, if one frame includes 10 sub-fields, then the number of gray level becomes merely eleven as indicated by the following table:

TABLE 1

| Gray Level | SF1 (1) | SF2 (2) | SF3 (4) | SF4 (8) | SF5 (16) | SF6 (32) | SF7 (48) | SF8 (48) | SF9 (48) | SF10 (48) |
|---|---|---|---|---|---|---|---|---|---|---|
| 0 | X | X | X | X | X | X | X | X | X | X |
| 1 | ○ | X | X | X | X | X | X | X | X | X |
| 3 | ○ | ○ | X | X | X | X | X | X | X | X |
| 7 | ○ | ○ | ○ | X | X | X | X | X | X | X |
| 15 | ○ | ○ | ○ | ○ | X | X | X | X | X | X |
| 31 | ○ | ○ | ○ | ○ | ○ | X | X | X | X | X |
| 63 | ○ | ○ | ○ | ○ | ○ | ○ | X | X | X | X |
| 111 | ○ | ○ | ○ | ○ | ○ | ○ | ○ | X | X | X |
| 159 | ○ | ○ | ○ | ○ | ○ | ○ | ○ | ○ | X | X |
| 207 | ○ | ○ | ○ | ○ | ○ | ○ | ○ | ○ | ○ | X |
| 255 | ○ | ○ | ○ | ○ | ○ | ○ | ○ | ○ | ○ | ○ |

In Table 1, 'O' represents a state in which a discharge cell is turned on at the corresponding sub-field; and 'x' represents a state in which a discharge cell is turned off at the corresponding sub-field.

In this case, since only 1331 colors are expressed by all combination of red, green and blue colors, color expression ability becomes considerably low in comparison to 16,700,000 true colors. The plasma display adopting such a system has a darkroom contrast ratio of 430:1 by a peak white of 950 cd/m$^2$ when the entire field is turned on in the display interval of 9.57 ms and a black of 2.2 cd/m$^2$ which is a brightness value obtained by adding a brightness of 0.7 cd/m$^2$ generated in once reset period to a brightness of 1.5 cd/m$^2$ generate in once entire writing interval.

As described above, in the conventional plasma display driving method, the selective writing system fails to drive the plasma display at a high speed because the data pulse and the scanning pulse for selectively turning on the discharge cells during the address period are relatively wide. The selective erasing system has an advantage in that it can drive the plasma display at a high speed because the data pulse and the scanning pulse for selectively turning off the discharge cells may be narrower than those in the selective writing system, whereas it has a disadvantage of a worse contrast than the selective writing system because the discharge cells at the entire field is turned on in the reset period, that is, the non-display interval.

SUMMARY OF THE INVENTION

Accordingly, it is an object of the present invention to provide a plasma display driving method and apparatus that is adaptive for driving the plasma display at a high speed as well as improving a contrast.

A further object of the present invention is to provide a plasma display driving method and apparatus that is adaptive for stabilizing an initialization upon selective erasing when the selective writing and the selective erasing are made simultaneously.

In order to achieve these and other objects of the invention, a method of driving a plasma display according to one aspect of the present invention, which selects discharge cells using selective writing sub-fields and selective erasing sub-fields arranged within one frame period and is provided with a plurality of scan electrodes, a plurality of sustain electrodes and a plurality of address electrodes, includes the steps of applying a normal sustaining pulses to on-cells selected to sustain a discharge of the on-cells; and applying an initialization pulse having at least one of a pulse width and a voltage level set to be larger than said normal sustaining pulse prior to the selective erasing sub-fields.

In the method, wherein a pulse width of said initialization pulse is approximately 5 to 50 μs.

A voltage level of said initialization pulse is approximately 170 to 250V.

Said selective writing sub-field is arranged prior to said selective erasing sub-field.

Said selective erasing sub-field is arranged between said selective writing sub-fields.

A different selective writing sub-field other than the last selective writing sub-field adjacent to said selective erasing sub-field, of said selective writing sub-fields arranged within said one frame, includes a reset period for initializing all the cells of the plasma display, an address period for causing a sustain discharge with respect to said on-cells, and a post erase period for erasing electric charges left within the discharge cell.

Herein, the last selective writing sub-field includes a reset period for initializing all the cells of the plasma display, a writing address period for selecting said on-cells and a sustain period for causing a sustain discharge with respect to said on-cells.

Said selective writing sub-field includes an erasing address period for selecting off-cells, and a sustain period for causing a sustain discharge with respect to said on-cells.

Herein, the last selective erasing sub-field adjacent to said selective writing sub-field, of said selective erasing sub-field, further includes a post erase period for erasing electric charges left within the discharge cell by said sustain discharge.

Said reset period includes applying a set-up voltage with a rising slope and a set-down voltage to the scan electrodes of the plasma display; and applying the first direct current voltage to the sustain electrodes during a time period when said set-down voltage is applied to the scan electrodes.

Said writing address period includes applying the first scanning voltage to the scan electrodes of the plasma display; applying a data voltage synchronized with the scan voltage to the address electrodes; and applying the second direct current voltage different from the first direct current voltage to the sustain electrodes.

Herein, said first direct current voltage is higher than said second direct current voltage.

An initiation sustaining pulse generated firstly for each sub-field has a larger pulse width than said normal sustaining pulse.

A method of driving a plasma display according to another aspect of the present invention, which makes a time-divisional driving of one frame period into a plurality of sub-fields, includes the steps of setting a sustaining and initialization pulse having a pulse width corresponding to a sum of the first time for causing a sustain discharge with respect to a cell selected at the first sub-field and the second time for stabilizing an initialization of the second sub-field following the first sub-field; and applying said sustaining and initialization pulse to electrodes of the plasma display between the first and second sub-fields.

In the method, said first sub-field is a selective writing sub-field for selecting an on-cell by a writing address discharge.

Said second sub-field is a selective erasing sub-field for selecting an off-cell by an erasing address discharge.

A pulse width of said sustaining and initialization pulse is approximately 5 to 50 μs.

A method of driving a plasma display according to still another aspect of the present invention, which makes a time-divisional driving of one frame period into a plurality of sub-fields, includes the step of applying a plurality of sustaining pulses for causing a sustain discharge with respect to a cell selected from at least one of the sub-fields to electrodes of the plasma display, wherein a pulse width of the last sustaining pulse of the plurality of sustaining pulses is larger than an average pulse width of the previous sustaining pulses.

In the method, a pulse width of said last sustaining pulse is approximately 5 to 50 μs.

A driving apparatus for a plasma display according to still another aspect of the present invention, which selects discharge cells using selective writing sub-fields and selective erasing sub-fields arranged within one frame period and is provided with a plurality of scan electrodes, a plurality of sustain electrodes and a plurality of address electrodes, includes the first scanning & addressing circuit for selecting on-cells using a writing discharge at each of said selective writing sub-fields; the second scanning & addressing circuit for selecting off-cells from said on-cells using an erase discharge at each of said selective erasing sub-fields; and a sustaining circuit for applying a normal sustaining pulse to the selected on-cells to sustain a discharge of said on-cells and for applying an initialization pulse having at least one of a pulse width and a voltage level set to be larger than said normal sustaining pulse prior to said selective erasing sub-fields.

In the driving apparatus, said sustaining circuit generates said initialization pulse having a pulse width of approximately 5 to 50 μs.

Said sustaining circuit generates said initialization pulse having a voltage level of approximately 170 to 250V.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 5:
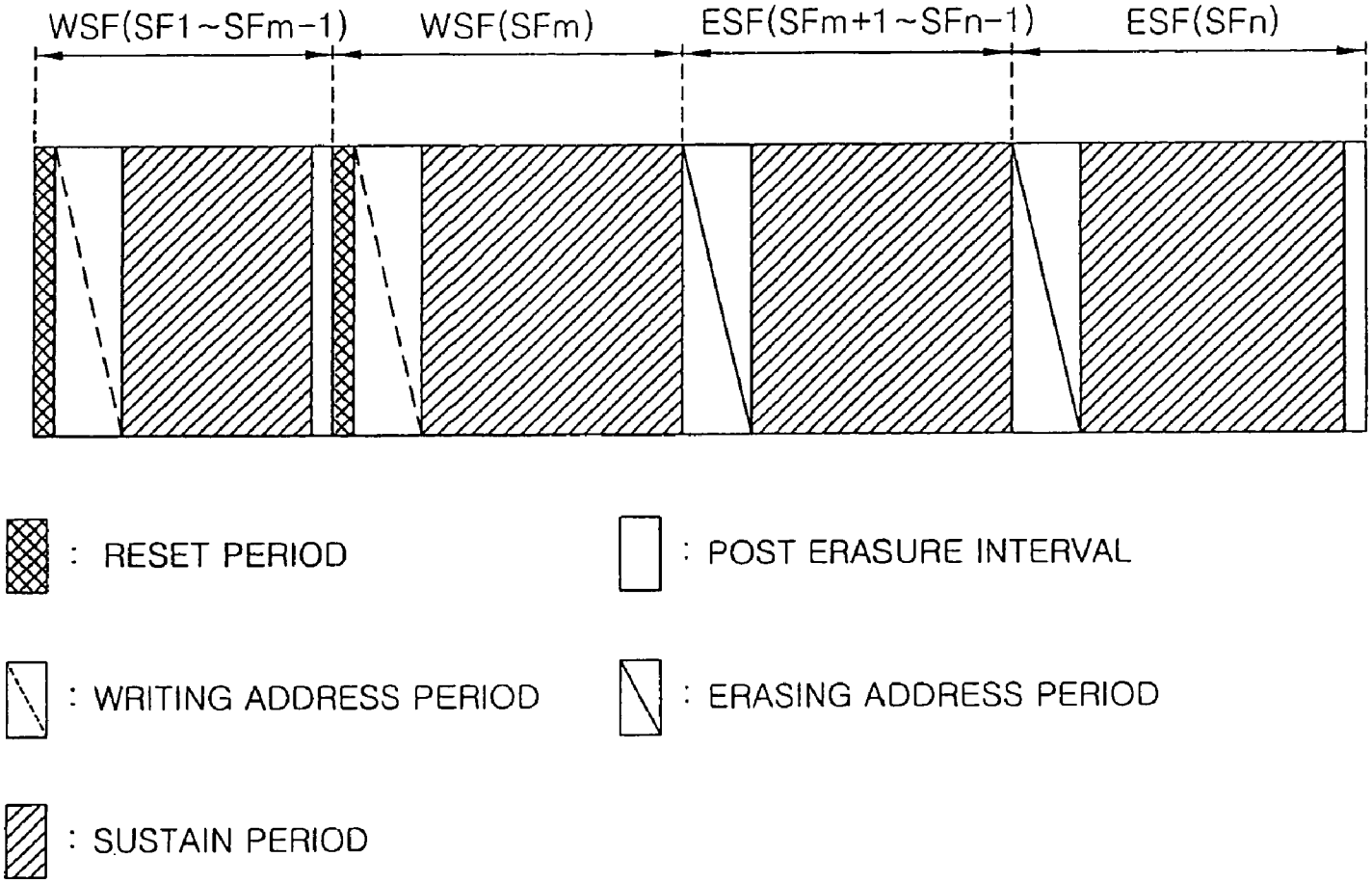
FIG. 5 illustrates a configuration of one frame in a method of driving a plasma display according to an embodiment of the present invention.

FIG. 5 shows a configuration of one frame in a method of driving a plasma display according to the first embodiment of the present invention.

Referring to FIG. 5, one frame is comprised of a selective writing sub-field WSF including at least one sub-field, and a selective erasing sub-field ESF including at least one sub-field.

The selective writing sub-field WSF includes m sub-fields SF1 to SFm (wherein m is an integer). Each of the first to (m−1)th sub-fields SF1 to SFm−1 other than the mth sub-field SFm is divided into a reset period for uniformly forming a certain amount of wall charges at the discharge cells of the entire field, a writing address period for selecting discharge cells to be turned on (hereinafter referred to as "on-cells") using the writing discharge, a sustain period for causing a sustain discharge with respect to the selected on-cells, and a post erase period for erasing wall charges within the cell after the sustain discharge. The mth sub-field SFm, which is the last sub-field of the selective writing sub-field WSF, is divided into a reset period, a writing address period and a sustain period. The reset period, the writing address period and the erase period of the selective writing sub-field are equal to each other for each sub-field SF1 to SFm, whereas the sustain period may be set equally or differently depending upon a predetermined brightness weighting value.

Meanwhile, the reset period arranged at the selective writing sub-field WSF may be omitted. Further, a separate erase period for applying an erasing signal to at least one of the scan electrodes and the sustain electrodes so as to erase all the wall charges within the cell having been accumulated at the previous frame at the front of the first sub-field SF1 of the selective writing sub-field WSF.

The selective erasing sub-field ESF includes (n-m) sub-fields SFm+1 to SFn (wherein n is an integer larger than m). Each of the (m+1)th to (n−1)th sub-fields SFm+1 to SFn−1 is divided into an erase address period for selecting discharge cells to be turned off (hereinafter referred to as "off-cells") using an erase discharge, and a sustain period for causing a sustain discharge with respect to the unselected on-cells. The nth sub-field SFn, which is the last sub-field of the selective erasing sub-field ESF, further includes a post erase period arranged at the last stage in such a manner to follow the sustain period besides the erase address period and the sustain period. In the sub-fields SFm+1 to SFn of the selective erasing sub-field ESF, the erase address period is set equally, whereas the sustain period may be set equally or differently depending upon a brightness relative ratio.

The last sub-field of the selective erasing sub-field ESF, that is, the nth sub-field SFn has a post erase period arranged lastly in similarity to the 1st to (m−1)th sub-fields SF1 to SFm−1 of the selective writing sub-field WSF, whereas the last sub-field of the selective writing sub-field WSF, that is, the mth sub-field SFm has no post erase period in similarity to the (m+1)th to (n−1)th sub-fields SFm+1 to SFn−1 of the selective erasing sub-field WSF.

A data coding method for addressing will be described below.

If it is assumed that one frame period should be time-divided into 6 selective writing sub-fields SF1 to SF6 in which a brightness relative ratio is given differently to "$2^0$, $2^1$, $2^2$, $2^3$, $2^4$, $2^5$" and 6 selective erasing sub-fields SF7 to SF12 in which a brightness relative ratio is given equally to "$2^5$", then a gray level and a coding method expressed by a combination of the sub-fields SF1 to SFn is given in the following table:

TABLE 2

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0~31 | Binary Coding | | | | | X | X | X | X | X | X | X |
| 32~63 | Binary Coding | | | | | ○ | X | X | X | X | X | X |
| 64~95 | Binary Coding | | | | | ○ | ○ | X | X | X | X | X |
| 96~127 | Binary Coding | | | | | ○ | ○ | ○ | X | X | X | X |
| 128~159 | Binary Coding | | | | | ○ | ○ | ○ | ○ | X | X | X |
| 160~191 | Binary Coding | | | | | ○ | ○ | ○ | ○ | ○ | X | X |
| 192~223 | Binary Coding | | | | | ○ | ○ | ○ | ○ | ○ | ○ | X |
| 224~255 | Binary Coding | | | | | ○ | ○ | ○ | ○ | ○ | ○ | ○ |

As can be seen from the above Table 2, the first to fifth sub-fields SF1 to SF5 arranged at the front of the frame determine a brightness of the discharge cell by the binary coding to thereby express a gray level value. The sixth to twelfth sub-fields SF6 to SF12 determine a brightness of the discharge cell by the linear coding at more than a desired gray level value to thereby express a gray level value. For instance, the discharge cell corresponding to a gray level value '11' is selected into an on-cell at the first, second and fourth sub-fields SF1, SF2 and SF4 in which the respective brightness relative ratio are $2^0$(1), $2^1$(2) and $2^3$(8) by the binary code combination to thereby be turned on while being selected into an off-cell at the remaining sub-fields to thereby be turned off. On the other hand, the cell corresponding to a gray level value '74' is selected into an on-cell at the second and fourth sub-fields SF2 and SF4 by the binary code combination and is selected into an on-cell at the sixth and seventh sub-fields SF6 and SF7 by the linear code combination to thereby be turned on while being selected into an off-cell at the remaining sub-fields to thereby be turned off.

The seventh to twelfth sub-fields SF7 to SF12 of the selective erasing sub-field ESF select off-cells from discharge cells selected into on-cells at the previous sub-field. In other words, the seventh to twelfth sub-fields SF7 to SF12 of the selective erasing sub-field ESF sequentially take out the unnecessary discharge cells from the on-cells having been turned on at the previous sub-field to thereby select off-cells. For this reason, on-cells turned on at more than a desired gray level value should be necessarily turned on at the sixth sub-field SF6, which is the last sub-field of the selective writing sub-field WSF, or the previous selective erasing sub-field ESF. For instance, off-cells turned off at the seventh sub-field SF7 are selected from on-cells selected at the sixth sub-field SF6 while off-cells turned off at the eighth sub-field SF8 are selected from the remaining on-cells at the seventh sub-field SF6. Accordingly, the seventh sub-fields SF7 of the selective erasing sub-field ESF does not require a separate writing discharge for turning on the discharge cells of the entire field prior to the erase address period. Further, the eighth to twelfth sub-fields SF8 to SF12 also selectively turn off on-cells having been turned on at the previous sub-field without a full writing.

If it is assumed that one frame should be time-divided into the selective writing sub-field WSF and the selective erasing sub-field ESF and the plasma display should have a resolution of VGA class, that is, 480 scan lines as indicated in the above Table 2, then total time occupied by the address period from one frame period is 11.52 ms. This address period is a sum of 8.64 ms calculated by 3 μs (a pulse width of the selective writing scanning pulse)×480 lines×6 (the number of selective writing sub-fields) with 2.88 ms calculated by 1 μs (a pulse width of the selective erasing scanning pulse)×480 lines×6 (the number of selective erasing sub-fields). On the other hand, a time occupied by the sustain period from one frame period is 3.35 ms. The sustain period is a time value (i.e., 16.67 ms−8.64 ms−2.88 ms−0.3 ms−1 ms−0.5 ms) obtained by subtracting an address period of 11.52 ms, once reset period of 0.3 ms, an erase period of 100 μs×5 (the number of sub-fields)=0.5 ms and an extra time of the vertical synchronizing signal Vsync of 1 ms from one frame period of 16.67 ms. Accordingly, the plasma display driving method according to the embodiment of the present invention increases the number of sub-fields in comparison with the conventional selective writing system, thereby reducing a pseudo contour noise from a moving picture. Furthermore, the plasma display driving method according to the embodiment of the present invention can assure a greater time of sustain period that is increased from 3.05 ms when one frame includes 8 sub-fields in the conventional selective writing system into 3.35 ms.

Meanwhile, a pulse width of the scanning pulse at the selective writing sub-field WSF is not limited to 3 μs, but may be selected into a range of 1 μs to 3 μs. Also, a pulse width of the scanning pulse −SESCN of the selective erasing sub-field ESF may be selected into 1.5 μs.

When one frame period is time-divided into the selective writing sub-field WSF and the selective erasing sub-field ESF as indicated in the above Table 2, if the entire field continues to be turned on in the sustain period of 3.35 ms, then a light of about 330 cd/$m^2$ corresponding to a brightness of the peak white is produced. If the field is turned on only in once reset period within one frame, then a light of about 0.7 cd/$m^2$ corresponding to a black is produced. Accordingly, a dark-room contrast ratio in the plasma display driving method according to the embodiment of the present invention is a level of 470:1, so that it permits an improved contrast in light of a contrast ratio (i.e., 60:1) in the conventional selective erasing system in which one frame period is time-divided into 10 sub-fields. Further, the plasma display driving method according to the embodiment of the present invention has an enhanced contrast characteristic in light of a contrast ratio (i.e., 430:1) in the conventional selective writing system in which one frame period includes 8 sub-fields.

The following Table 3 shows a sub-field arrangement that is more advantageous to a high-speed driving and permits more improved contrast ratio than the sub-field arrangement in Table 2.

TABLE 3

| Gray Level | SF1 (1) | SF2 (2) | SF3 (4) | SF4 (8) | SF5 (16) | SF6 (16) | SF7 (24) | SF8 (32) | SF9 (40) | SF10 (50) | SF11 (62) |
|---|---|---|---|---|---|---|---|---|---|---|---|
| 0~15 | Binary Coding | | | | X | X | X | X | X | X | X |
| 16~31 | Binary Coding | | | | ○ | X | X | X | X | X | X |
| 32~47 | Binary Coding | | | | ○ | ○ | X | X | X | X | X |
| 56~71 | Binary Coding | | | | ○ | ○ | ○ | ○ | X | X | X |
| 88~103 | Binary Coding | | | | ○ | ○ | ○ | ○ | X | X | X |
| 128~143 | Binary Coding | | | | ○ | ○ | ○ | ○ | ○ | X | X |
| 178~193 | Binary Coding | | | | ○ | ○ | ○ | ○ | ○ | ○ | X |
| 240~255 | Binary Coding | | | | ○ | ○ | ○ | ○ | ○ | ○ | ○ |

Figure 1:
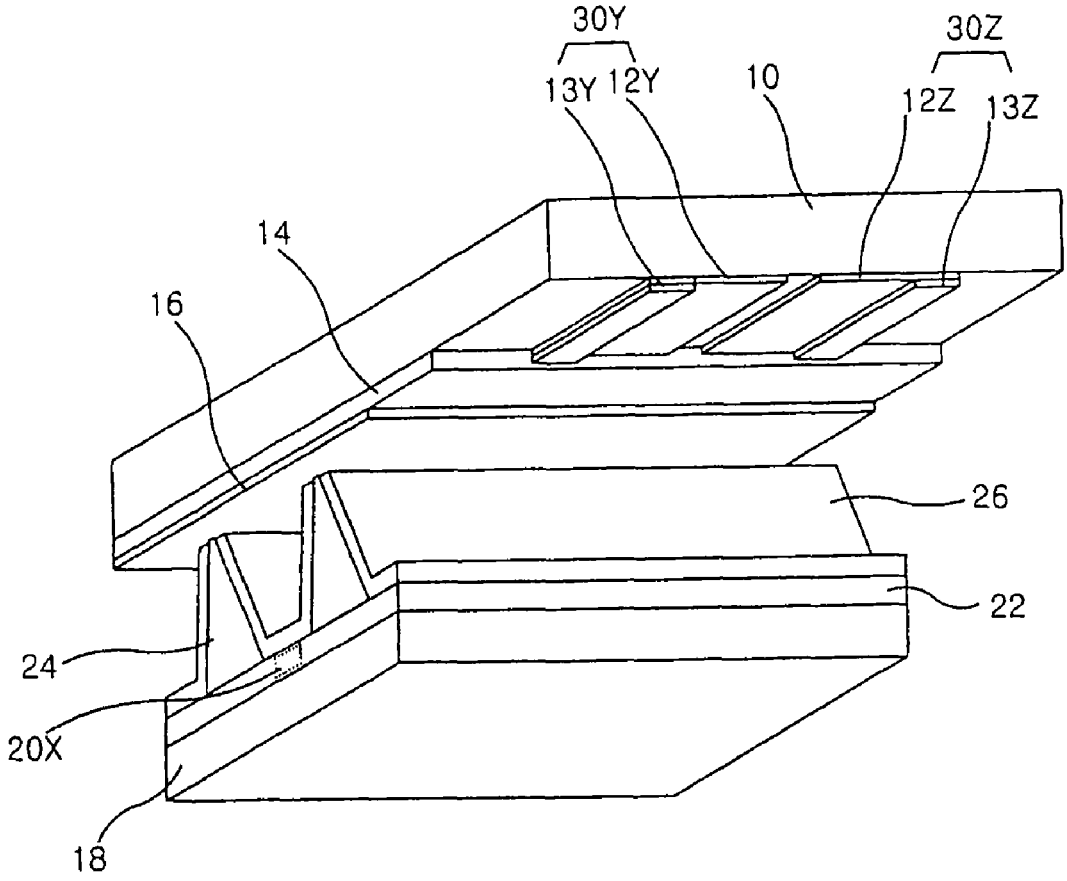
FIG. 1 RELATED ART
FIG. 1 is a perspective view showing a discharge cell structure of a conventional three-electrode AC surface-discharge plasma display.
Figure 2:
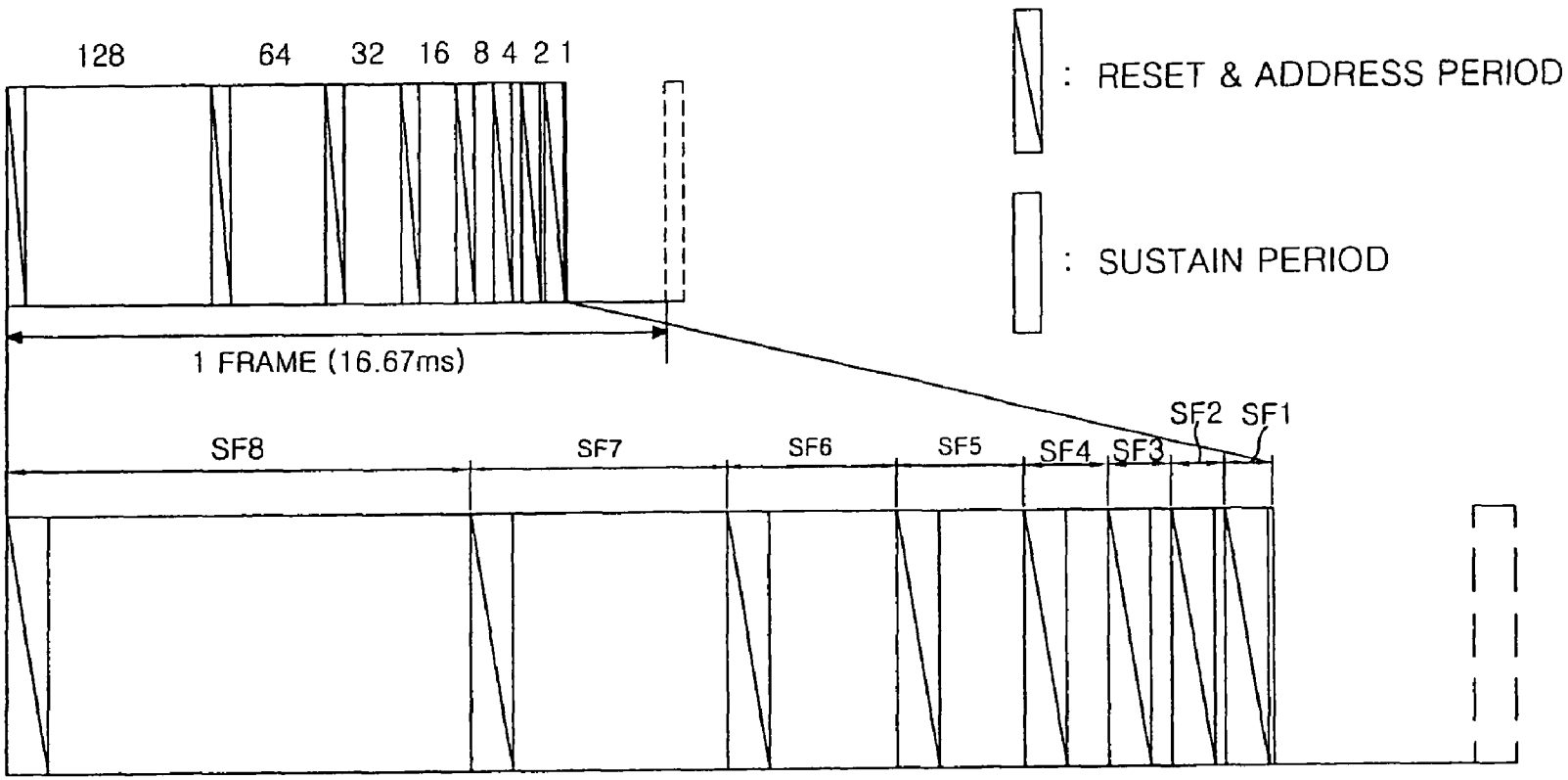
FIG.2 RELATED ART
FIG. 2 illustrates one frame including 8 sub-fields in a method of driving the conventional plasma display.
Figure 3:
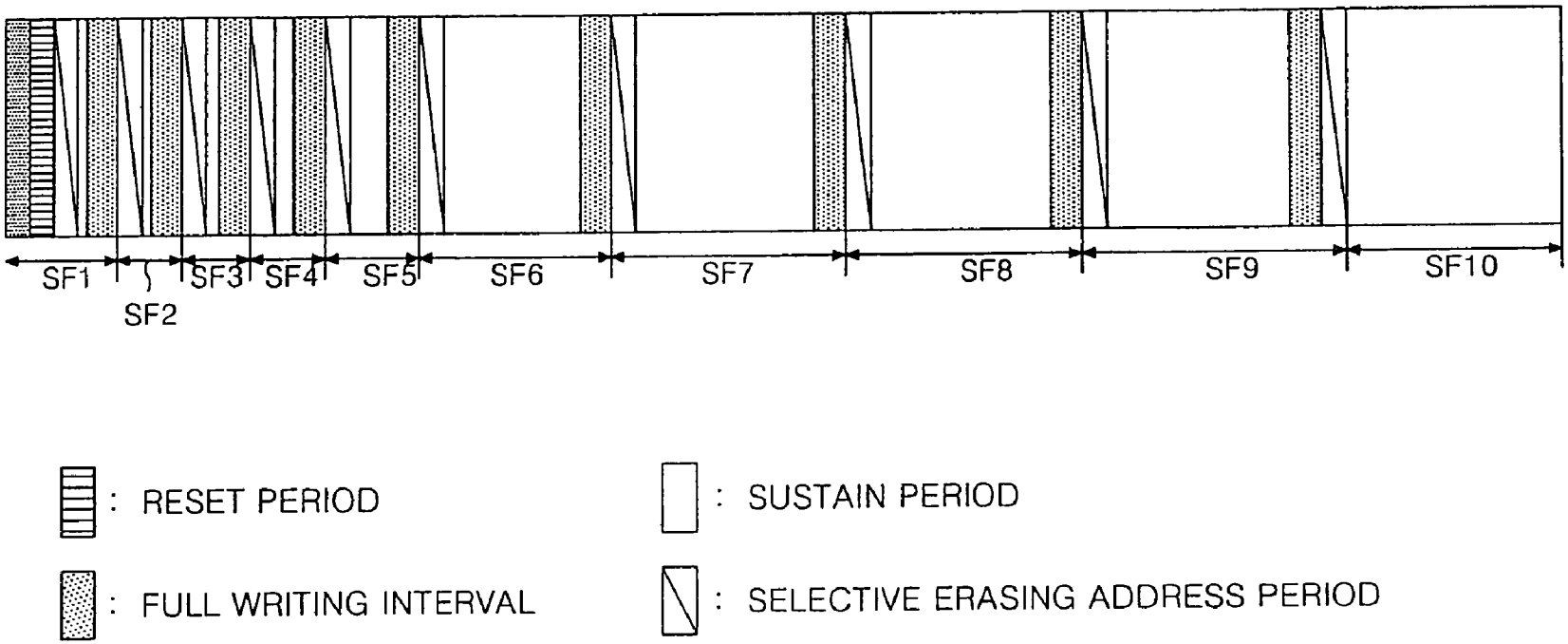
FIG.3 RELATED ART
FIG. 3 illustrates a configuration of one frame including 8 sub-fields and having an entire writing discharge preceded for each sub-field in the method of diving the conventional plasma display.
Figure 4:
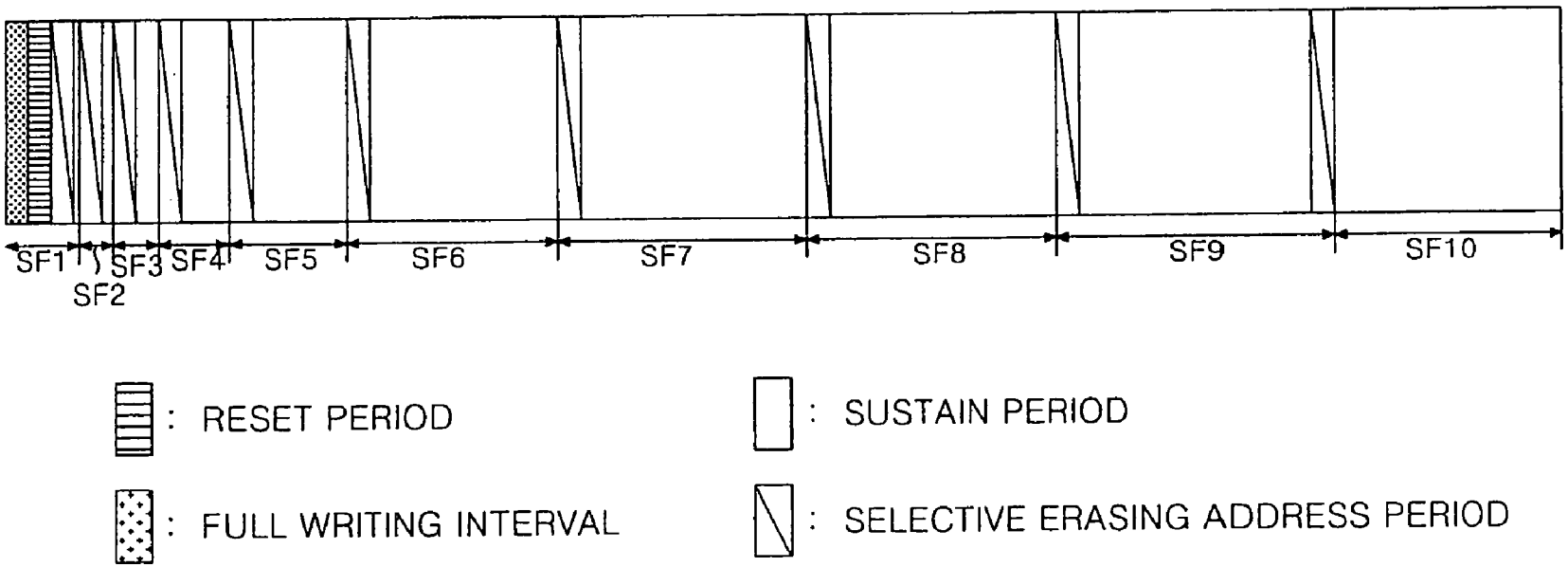
FIG. 4 RELATED ART
FIG. 4 illustrates a configuration of one frame including 8 sub-fields and including once entire writing discharge in the method of diving the conventional plasma display.

The sub-field arrangement in FIG. 3 includes 5 selective writing sub-fields SF1 to SF5 given to a different brightness relative ratio and 6 selective erasing sub-fields SF6 to SF11 given to a different brightness relative ratio. The sixth to eleventh sub-fields SF6 to SF11 as the selective erasing sub-field WSF selects off-cells while sequentially taking out the unnecessary cells from on-cells having been turned on at the previous sub-field.

As can be seen from Table 3, the first to fourth sub-fields SF1 to SF5 arranged at the front of the frame express a gray level value using the binary coding. The fifth to eleventh sub-fields SF5 to SF12 express a gray level value using the linear coding at more than a desired gray level value. For instance, the discharge cell corresponding to a gray level value '11' is selected into an on-cell at the first, second and fourth sub-fields SF1, SF2 and SF4 in which the respective brightness relative ratio are $2^0(1)$, $2^1(2)$ and $2^3(8)$ by the binary code combination to thereby be turned on while being selected into an off-cell at the remaining sub-fields to thereby be turned off. On the other hand, the cell corresponding to a gray level value '42' is selected into an on-cell at the second and fourth sub-fields SF2 and SF4 by the binary code combination and is selected into an on-cell at the sixth and seventh sub-fields SF6 and SF7 by the linear code combination to thereby be turned on while being selected into an off-cell at the remaining sub-fields to thereby be turned off.

In the sub-field arrangement in Table 3, a portion of gray level values is not expressed. In other words, a gray level value between 0 to 47 can be expressed, but a gray level range of 48 to 55, 72 to 87, 104 to 127, 144 to 178 and 194 to 239 cannot be expressed by the binary code combination and the linear code combination in Table 3. The unexpressed gray level range can be expressed in similarity to gray level values to be expressed by the dithering or error diffusion scheme.

When the plasma display has a resolution of VGA class, a time required for the address period in the sub-field arrangement in Table 3 is merely 10.08 ms. As the address period is reduced, the sustain period can be sufficiently assured as 4.89 ms. Herein, the address period is a sum of 7.2 ms calculated by 3 μs (a pulse width of the selective writing scanning pulse)×480 lines×5 (the number of selective writing sub-fields) with 2.88 ms calculated by 1 μs (a pulse width of the selective erasing scanning pulse)×480 lines×6 (the number of selective erasing sub-fields) per frame. The sustain period is a time value (i.e., 16.67 ms−10.08 ms−0.3 ms−1 ms−0.4 ms) obtained by subtracting an address period of 11.52 ms, once reset period of 0.3 ms, an erase period of 100 μs×4 (the number of sub-fields)=0.4 ms and an extra time of the vertical synchronizing signal Vsync of 1 ms from one frame period of 16.67 ms per frame.

If the entire field continues to be turned on in the sustain period of 4.89 ms, then a light of about 490 cd/m$^2$ corresponding to a brightness of the peak white is produced. On the other hand, if the field is turned on only in once reset period within one frame, then a light of about 0.7 cd/m$^2$ corresponding to a black is produced. Accordingly, a darkroom contrast ratio in the plasma display driving method according to the second embodiment of the present invention is a level of 700:1.

Figure 6:
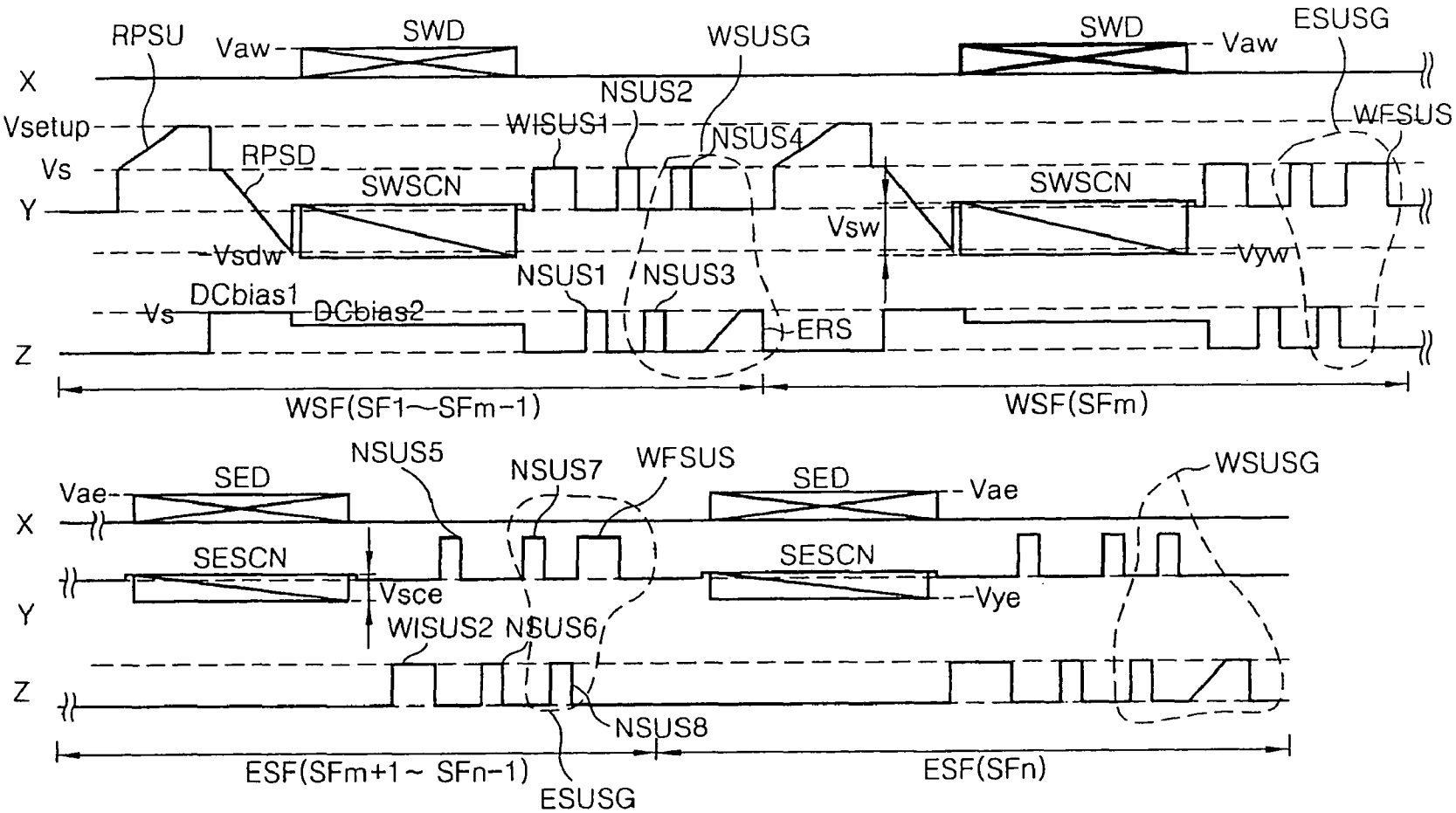
FIG. 6 is a waveform diagram of driving signals in the method of driving the plasma display according to the embodiment of the present invention.

FIG. 6 shows a driving waveform in the plasma display driving method according to the first embodiment of the present invention.

Referring to FIG. 6, in the reset period of the selective writing sub-field WSF, a ramp waveform RPSU with a rising slope rising until a set-up voltage Vsetup is simultaneously applied to all the scan electrode lines. Herein, the set-up voltage Vsetup is higher than a sustain voltage Vs and is set to a range of about 200V to 280V. The sustain voltage Vs is set to a range of about 170V to 250V. At the same time, 0V or a ground voltage GND is applied to the sustain electrode lines Z and the address electrode lines X. The rising ramp waveform RPSU allows a dark discharge in which a light is almost not generated to be caused between the scan electrode lines Y and the address electrode lines X and the scan electrode lines Y and the sustain electrode lines Z within the cells of the entire field. By this set-up discharge, positive (+) wall charges are accumulated onto the address electrode lines X and the sustain electrode lines Z while negative (−) wall charges are accumulated onto the scan electrode lines Y. Total amount of the negative (−) wall charges accumulated on the scan electrodes Y is equal to that of the positive (+) wall charges accumulated on the address electrodes X and the sustain electrodes Z.

After the set-up discharge, a positive voltage lower than the set-up voltage Vsetup, for example, a falling ramp waveform RPSD with a falling slope falling from the sustain voltage Vs until a set-down voltage. −Vsdw is applied to the scan electrodes Y and, at the same time, the first direct current bias voltage DCbias1 is applied to the sustain electrodes Z. Herein, the first direct current bias voltage DCbias1 is set to the sustain voltage Vs, and the set-down voltage −Vsdw is a voltage having a lower absolute value than a scan voltage −Vyw of the selective writing sub-field WSF, which is set to a range of about −30V to −40V. A voltage difference between the falling ramp waveform RPSD and the first direct current bias voltage DCbias1 causes a dark discharge in which a light is almost not generated between the scan electrode Y and the sustain electrodes Z. Further, a dark discharge occurs during a range in which the falling ramp waveform RPSD falls between the scan electrodes Y and the address electrodes X. The set-down discharge caused by the falling ramp waveform RPSD erases excessive wall charges that does not contribute to the address discharge from electric charges produced by the rising ramp waveform RPSU. In other words, the falling ramp waveform RPSD plays a role to establish a stable initial condition of writing address.

Meanwhile, since the falling ramp waveform RPSD falls until a set-down voltage Vsdw higher than the negative scan voltage −Vyw rather than falling until the negative scan voltage −Vyw, wall charges within the discharge cells contributing to the address discharge are sufficiently left in comparison with a case where the falling ramp waveform RPSD falls until the negative scan voltage −Vyw just after the reset period. Just after the reset period, negative wall charges are left on the scan electrode Y while positive wall charges are left on the sustain electrode Z and the address electrode X. The sufficient wall charges having been left just after the reset period allow a data voltage for causing a writing discharge in the address period to be lower in comparison with a case where the falling ramp waveform RPSD falls until the negative writing scan voltage −Vwy.

In the writing address period of the selective writing sub-field WSF, a writing scanning pulse SWSCN falling until the negative writing scan voltage −Vyw are sequentially applied to the scan electrodes Y and, at the same time, a writing data pulse SWD is applied to the address electrodes X in such a manner to be synchronized with the writing scanning pulse SWSCN. Herein, an absolute value sum of the negative scan voltage −Vyw, which is a lower limit voltage of the writing scanning pulse SWSCN with a swing width voltage Vscw is set to be larger than 0V such that a misfire does not occur at a high-temperature environment more than about 40° C. The swing width voltage Vscw is a voltage from the negative scan voltage −Vyw until a writing scan reference voltage. For example, the negative writing scan voltage −Vyw is set to about −40V to −70V, and an absolute value of the swing width voltage Vscw is set to a relatively large value of about 100V to 130V. When the negative scan voltage −Vyw and the writing swing width voltage Vscw are set as described above, a voltage Vaw of the writing data pulse SWD is set to a range of about 45 to 80V.

Pulse widths of the writing scanning pulse SWSCN and the writing data pulse SWD are set to about 3 μs, but it may be selected into a range of 1 μs to 3 μs. A writing discharge is generated within on-cells supplied with the writing data pulse SWD while a voltage difference between the writing scanning pulse −SWSCN and the writing data pulse SWD being added to a wall voltage within the discharge cell accumulated previously. This writing discharge allows positive wall charges to be accumulated onto the scan electrode Y while allowing negative wall charges to be accumulated onto the sustain electrode Z and the address electrode X. The wall charges formed in this manner lowers an external application voltage for causing a sustain discharge during the sustain period, that is, a sustain voltage Vs.

In the writing address period of the selective writing sub-field WSF, the second direct current bias voltage DCbias2 lower than the sustain voltage Vs is applied to the sustain electrodes Z. The second direct current bias voltage DCbias2 allows a writing discharge for selecting on-cells to be mainly generated between the address electrode X and the scan electrode Y and allows negative wall charges to be accumulated onto the sustain electrode Z within the on-cells upon writing discharge, thereby lowering an external application voltage required for the sustain discharge, that is, the sustain voltage Vs.

In an initial time of the sustain period of the selective writing sub-field WSF, a initiation sustaining pulse WISUS1 having a large pulse width of about 10 μs to 50 μs and a voltage level of the sustain voltage Vs is applied to the scan electrodes Y. The initiation sustaining pulse WISUS1 is set to have a larger pulse width than normal sustaining pulses NSUS1 to NSUS4 to more increase an amount of wall charges within the on-cell when the sustain period is initiated than when the normal sustaining pulses NSUS1 to NSUS4 are applied at an initial time of the sustain period, thereby stabilizing a sustain discharge. Following the initiation sustaining pulse WISUS1, the normal sustaining pulses NSUS2 and NSUS3 are alternately applied to the scan electrodes Y and the sustain electrodes Z after the sustain electrodes Y were supplied with the normal sustaining pulse NSUS1. Further, the last sustaining pulse is applied to the scan electrodes Y as the normal sustaining pulse NSUS4 at the first to (m−1)th sub-fields SF1 to SFm−1 other than the mth sub-field SFm that is the preceded sub-field of the selective erasing sub-field ESF. Herein, pulse widths of the normal sustaining pulses NSUS1 to NSUS4 are set to a range of about 1 μs to 5 μs. Whenever the sustaining pulses WISUS1, NSUS1 to NSUS4 and WFSUS are applied, the on-cells having caused a writing discharge during the writing address period generates a sustain discharge.

Meanwhile, the last sustaining pulses WSFUS of the mth sub-field SFm, which is the last sub-field of the selective writing sub-field WSF, is set to have a larger pulse width than the normal sustaining pulse NSUS4 and than an average value of the previous sustaining pulses WISUS1 and NSUS1 to NSUS4, thereby causing the last sustain discharge at the mth sub-field SFm and stabilizing an initialization of the (m+1)th sub-field SFm+1 of the selective erasing sub-field ESF. More specifically, if a pulse width of the sustaining pulse WSF becomes larger, then a stable sustain discharge is generated and wall charges within all the on-cells is uniformed with wall charges within the on-cells being increased until a certain amount rather than being reduced. If an amount of wall charges within the on-cells is initialized uniformly and sufficiently, then an address driving margin of the succeeding selective erasing sub-field ESF is widened and an address operation is stabilized. A pulse width of the last sustaining pulse WFSUS for initializing the selective erasing sub-field ESF is set to have a large value of about 5 μs to 50 μs, and a voltage level thereof is set to approximately the sustain voltage Vs. Alternatively, the last sustaining pulse WFSUS may be set to have a higher voltage level than the normal sustaining pulse instead of an enlarged pulse width. Also, it may be set to have a higher voltage level and a larger pulse with than the normal sustaining pulse.

After the last sustain discharge was generated at the first to (m−1)th sub-fields SF1 to SFm−1, a post erasing ramp waveform ERS gradually rising until the sustain voltage Vs is applied to the sustain electrodes Z. While this post erasing ramp waveform ERS causing a weak erase discharge within the on-cell, wall charges produced by the sustain discharge is erased. Otherwise, after the last sustain discharge was generated at the last sub-field SFm of the selective writing sub-field WSF, it is transferred to the first sub-field SFm+1 of the selective erasing sub-field ESF without any erasing signal. As a result, the post ramp waveform ERS or a erasing voltage (or waveform) having such an erasing function is arranged at the end of the corresponding sub-field only when the next sub-field is a selective writing sub-field WSF.

Just prior to an initiation of each sub-field SF1 to SFm of the selective writing sub-field WSF, a discharge condition of the discharge cells must be equal for each sub-field Sf1 to SFm. To this end, the last stage of the nth sub-field SFn, that is, the last sub-field of the selective erasing sub-field ESF and the last stage of the first to (m−1)th sub-fields SF1 to SFm−1 are arranged similarly with a writing sustain pulse group WSUSG. The writing sustain pulse group WSUSG includes the last normal sustaining pulse NSUS4 applied to the scan electrodes Y, the last normal sustaining pulse NSUS3 applied to the sustain electrodes Z, and the post erasing ramp waveform ERS.

In the address period of the selective erasing sub-field ESF, an erasing scanning pulse SESCN falling until a negative erasing scan voltage −Vye is sequentially applied to the scan electrodes Y and, at the same time, an erasing data pulse SED synchronized with the erasing scanning pulse SESCN is applied to the address electrodes X. Herein, an absolute value sum of the erasing scan voltage −Vye, which is a lower limit voltage of the erasing scanning pulse SESCN with an erasing scan swing width voltage Vsce is set to be 0V or be close to 0V such that a misfire does not occur upon the following sustain discharge. The erasing scan swing width voltage Vsce is a voltage from the erasing scan voltage −Vye until a scan reference voltage. This aims at allowing a voltage difference between the scan electrodes Y and the sustain electrodes Z to be not large, thereby preventing an erasure of wall charges accumulated within the on-cell. For example, the erasing scan voltage −Vye is set to about −20V to −40V, and the erasing scan swing width voltage Vsce is set to have a relatively small value of about 50V to 20V such that it is smaller than the writing scan reference voltage Vscw. When the negative scan voltage −Vye and the erasing scan swing width voltage Vsce are set as described above, a voltage Vae of the erasing data pulse SED is set to about 30V to 55V.

Pulse widths of the selective erasing scanning pulse −SESCN and the erasing data pulse SED are set to be smaller than those of the selective writing scanning pulse −SWSCN and the writing data pulse SWD, respectively. Under this condition, pulse widths of the erasing scanning pulse −SESCN and the erasing data pulse SED may be selected into 1.5 μs or less.

While a voltage difference between the selective erasing scanning pulse −SESCN and the selective erasing data pulse SED being added to a wall voltage within the on-cell sustained from the previous sub-field, an erase discharge is generated within the on-cell supplied with the selective erasing data pulse SED. This erase discharge erases wall charges within the on-cells enough not to cause a discharge even though the sustain voltage Vs is applied.

In the address period of the selective erasing sub-field ESF, 0V or a ground voltage GND is applied to the sustain electrodes Z.

The sustain period of the selective erasing sub-field ESF is initiated by applying an initiation sustaining pulse WISUS2 having a large pulse width of about 20 μs to 50 μs and a voltage level set to the sustain voltage Vs to the sustain electrodes Z such that a stable sustain discharge can be generated. Subsequently, a normal sustaining pulse NSUS5 is applied to the scan electrodes Y, and then normal sustaining pulses NSUS6, NSUS7 and NSUS7 are alternately applied to the sustain electrodes Z and the scan electrodes Z. Herein, the normal sustaining pulses NSUS5 to NSUS8 are set to have a pulse width of 1 μs to 5 μs. Whenever the sustaining pulses WISUS2 and NSUS5 to NSUS8 are applied in this manner, the on-cells having not caused an erase discharge in the erasing address period causes a sustain discharge. Further, the last sustaining pulse WFSUS arranged at the (m+1)th to (n−1)th sub-fields SFm+1 to SFn−1 other than the nth sub-field SFn, which is the last sub-field of the selective erasing sub-field, is set to have a voltage level of approximately the sustain voltage Vs and a pulse width required for an initial stabilization of the sustain discharge in similarity to that arranged at the last sub-field SFm of the selective writing sub-field WSF, and it is applied to the scan electrodes Y. The last sustaining pulse WFSUS causes a sustain discharge and uniforms an amount of wall charges within the on-cells sufficiently at a constant amount, thereby stabilizing an initialization of the following selective erasing sub-fields SFm+2 to SFn.

Meanwhile, an initiation sustaining pulse WISUS2 of the selective erasing sub-field ESF is applied to the sustain electrodes Z such that a discharge of the on-cell can be kept when the sustaining pulses NSUS4 and WFSUS applied at the end of the previous sub-field are applied to the scan electrodes Y. To the contrary, the initiation sustaining pulse WISUS2 of the current selective erasing sub-field ESF is applied to the scan electrodes Y such that a discharge of the on-cell can be kept when a sustaining pulse applied at the end of the previous sub-field is applied to the sustain electrodes Z.

Just prior to an initiation of each sub-field SFm+1 to SFn of the selective erasing sub-field ESF, a discharge condition of the discharge cells must be equal for each sub-field SFm+1 to SFn. To this end, the last stage of the mth sub-field SFm, that is, the last sub-field of the selective writing sub-field WSF and the last stage of the (m+1)th to (n−1)th sub-fields SFm+1 to SFn−1 are arranged similarly with an erasing sustain pulse group ESUSG. The Erasing sustain pulse group ESUSG includes the normal sustaining pulses NSUS3 and NSUS7 applied to the scan electrodes Y, and the sustaining pulses NSUS4 and NSUS8 sequentially applied to the sustain electrodes Z and the scan electrodes Y following the sustaining pulses NSUS3 and NSUS7.

Figure 7:
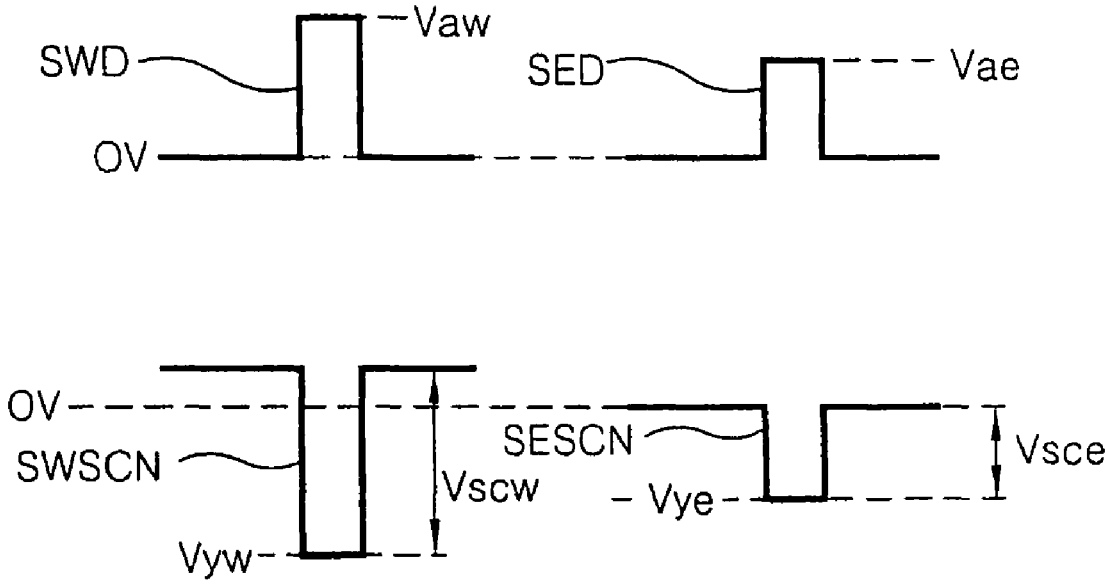
FIG. 7 is a detailed waveform diagram of the scanning pulse and the data pulse shown in FIG. 6.

In the plasma display driving method according to the embodiment of the present invention, data voltages Vaw and Vae and scan voltages −Vyw, Vscw, −Vye and Vsce at the selective writing sub-field WSF and the selective erasing sub-field ESF are set differently as shown in FIG. 6 and FIG. 7. This aims at assuring a driving margin as much as possible at the selective writing sub-field WSF and the selective erasing sub-field ESF having a different discharge characteristic. In other words, if an uniformity of the discharge cells of the plasma display becomes lower as a size of the plasma display goes larger or the discharge cell goes smaller, then a driving margin is narrowed to that extent. Thus, it is difficult to widen a driving margin at both the selective writing sub-field WSF and the selective erasing sub-field. Therefore, the scan voltages −Vyw, Vscw, −Vye and Vsce of the selective writing sub-field WSF and the selective erasing sub-field ESF are set differently as shown in FIG. 7. Further, the data voltages Vaw and Vae of the selective writing sub-field WSF and the selective erasing sub-field ESF are set differently or identically. Such a deferent setting of the scan voltages Vscw, −Yyw, Vsce and −Vye or such a different setting of the scan voltages Vscw, −Yyw, Vsce and −Vye and the data voltages Vaw and Vae at the selective writing sub-field WSF and the selective erasing sub-field ESF aims at establishing an optimum address discharge condition in correspondence with each address strategy and enlarging an address driving margin at each address strategy because an address strategy of the selective writing sub-field WSF is different from that of the selective erasing sub-field ESF. Also, it aims at preventing a generation of address misfire at a high temperature environment at the selective writing sub-field WSF as described above, and preventing a misfire of the sustain discharge generated in the sustain period following the address period.

Meanwhile, the data voltage Vae of the erasing data pulse SED is set to have a lower voltage level than that Vaw of the writing data pulse SWD when its pulse width is a relatively large when being set to have a higher voltage level than that Vaw of the writing data pulse SWD when its pulse width is a relatively small.

Figure 8:
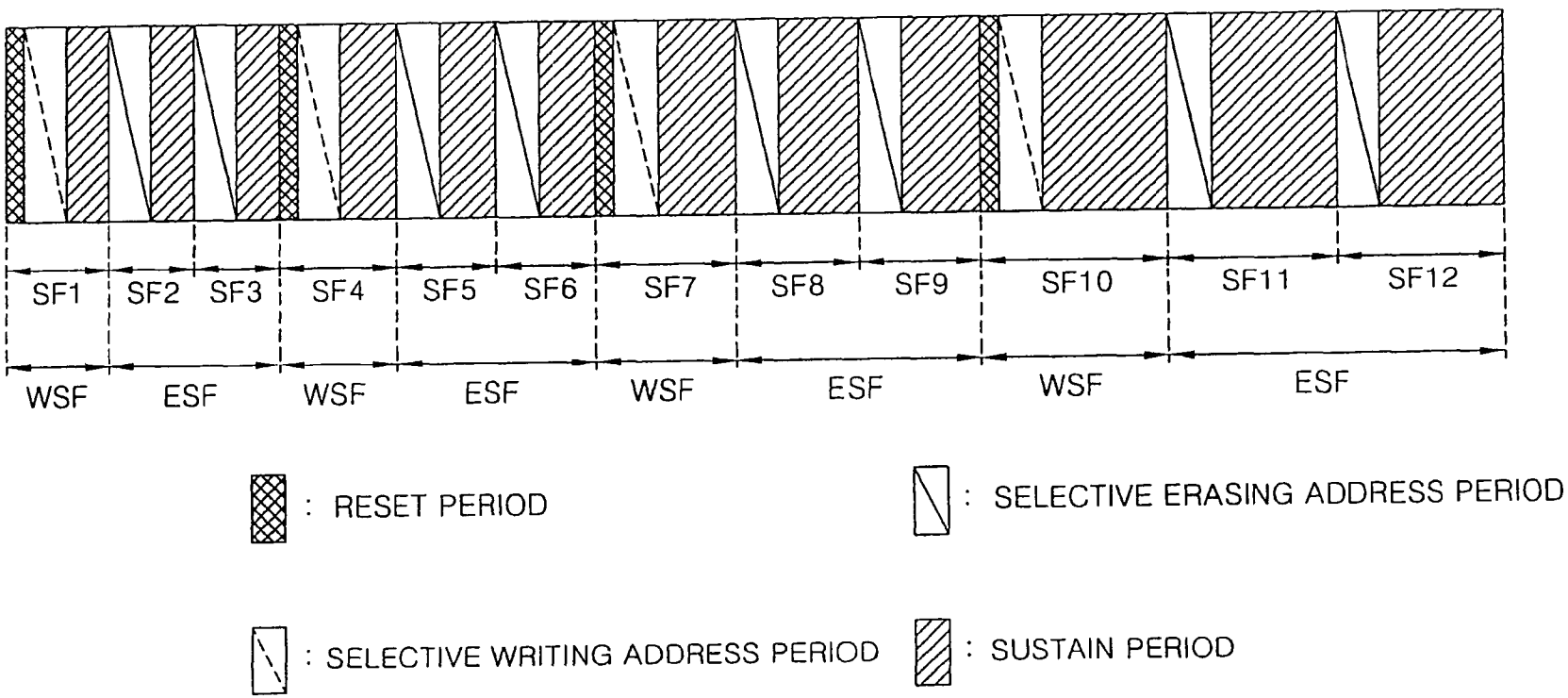
FIG. 8 illustrates a configuration of one frame in a method of driving a plasma display according to another embodiment of the present invention.

FIG. 8 shows a configuration of one frame in a plasma display driving method according to the second embodiment of the present invention.

Referring to FIG. 8, in the plasma display driving method according to the second embodiment of the present invention, there exists a region in which the selective writing sub-field WSF and the selective erasing sub-field ESF are alternated within one frame period.

The selective writing sub-field WSF includes the first sub-field SF1, the fourth sub-field SF4, the seventh sub-field SF7 and the tenth sub-field SF10. The selective erasing sub-field ESF includes the second and third sub-fields SF2 and SF3 arranged between the first sub-field SF1 and the fourth sub-field SF4, the fifth and sixth sub-fields SF5 and SF6 arranged between the fourth sub-field SF4 and the seventh sub-field SF7, the eighth and ninth sub-fields SF8 and SF9 arranged between the seventh sub-field SF7 and the tenth sub-field SF10, and the eleventh and twelfth sub-fields SF11 and SF12 arranged at the next of the tenth sub-field SF10.

The number of the selective erasing sub-fields ESF arranged between the selective writing sub-fields WSF may be optionally adjusted.

Each selective writing sub-field WSF is divided into a reset period for initializing the entire field by accumulating a uniform amount of wall charges within the discharge cells of the entire field, a writing address period for selecting on-cells and a sustain period for sustaining a discharge of the on-cells depending upon a brightness weighting value. The selective writing sub-field WSF may include a separate erase period (not shown) for erasing the sustain discharge.

On the other hand, each selective erasing sub-field ESF has not a reset period for initializing the entire field, and is divided into an erasing address period for selecting off-cells from the on-cells having been sustained from the previous sub-field, and a sustain period for causing a sustain discharge with respect to the on-cells having not generated an erase discharge during the erasing address period.

The following Tables 4-1 to 4-7 represent gray levels expressed by the plasma display driving method according to the second embodiment of the present invention and a coding method when it is assumed that brightness weighting values of the sub-fields should be assigned to a sequence of $2^0$, $2^0$, $2^0$, $2^2$, $2^2$, $2^2$, $2^4$, $2^4$, $2^4$, $2^6$, $2^6$, $2^6$ from the first sub-field SF1 until the twelfth sub-field SF12.

TABLE 4-1

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 |
| 4 | 0 | 0 | 0 | 1 | 0 | 0 | 0 | 0 | 0 | 0 | 0 | 0 |
| 5 | 1 | 0 | 0 | 1 | 0 | 0 | 0 | 0 | 0 | 0 | 0 | 0 |
| 6 | 1 | 1 | 0 | 1 | 0 | 0 | 0 | 0 | 0 | 0 | 0 | 0 |
| 7 | 1 | 1 | 1 | 1 | 0 | 0 | 0 | 0 | 0 | 0 | 0 | 0 |
| 8 | 0 | 0 | 0 | 1 | 1 | 0 | 0 | 0 | 0 | 0 | 0 | 0 |
| 9 | 1 | 0 | 0 | 1 | 1 | 0 | 0 | 0 | 0 | 0 | 0 | 0 |
| 10 | 1 | 1 | 0 | 1 | 1 | 0 | 0 | 0 | 0 | 0 | 0 | 0 |
| 11 | 1 | 1 | 1 | 1 | 1 | 0 | 0 | 0 | 0 | 0 | 0 | 0 |
| 12 | 0 | 0 | 0 | 1 | 1 | 1 | 0 | 0 | 0 | 0 | 0 | 0 |
| 13 | 1 | 0 | 0 | 1 | 1 | 1 | 0 | 0 | 0 | 0 | 0 | 0 |
| 14 | 1 | 1 | 0 | 1 | 1 | 1 | 0 | 0 | 0 | 0 | 0 | 0 |
| 15 | 1 | 1 | 1 | 1 | 1 | 1 | 0 | 0 | 0 | 0 | 0 | 0 |
| 16 | 0 | 0 | 0 | 0 | 0 | 0 | 1 | 0 | 0 | 0 | 0 | 0 |
| 17 | 1 | 0 | 0 | 0 | 0 | 0 | 1 | 0 | 0 | 0 | 0 | 0 |
| 18 | 1 | 1 | 0 | 0 | 0 | 0 | 1 | 0 | 0 | 0 | 0 | 0 |
| 19 | 1 | 1 | 1 | 0 | 0 | 0 | 1 | 0 | 0 | 0 | 0 | 0 |
| 20 | 0 | 0 | 0 | 1 | 0 | 0 | 1 | 0 | 0 | 0 | 0 | 0 |
| 21 | 1 | 0 | 0 | 1 | 0 | 0 | 1 | 0 | 0 | 0 | 0 | 0 |
| 22 | 1 | 1 | 0 | 1 | 0 | 0 | 1 | 0 | 0 | 0 | 0 | 0 |
| 23 | 1 | 1 | 1 | 1 | 0 | 0 | 1 | 0 | 0 | 0 | 0 | 0 |
| 24 | 0 | 0 | 0 | 1 | 1 | 0 | 1 | 0 | 0 | 0 | 0 | 0 |
| 25 | 1 | 0 | 0 | 1 | 1 | 0 | 1 | 0 | 0 | 0 | 0 | 0 |
| 26 | 1 | 1 | 0 | 1 | 1 | 0 | 1 | 0 | 0 | 0 | 0 | 0 |
| 27 | 1 | 1 | 1 | 1 | 1 | 0 | 1 | 0 | 0 | 0 | 0 | 0 |
| 28 | 0 | 0 | 0 | 1 | 1 | 1 | 1 | 0 | 0 | 0 | 0 | 0 |
| 29 | 1 | 0 | 0 | 1 | 1 | 1 | 1 | 0 | 0 | 0 | 0 | 0 |
| 30 | 1 | 1 | 0 | 1 | 1 | 1 | 1 | 0 | 0 | 0 | 0 | 0 |
| 31 | 1 | 1 | 1 | 1 | 1 | 1 | 1 | 0 | 0 | 0 | 0 | 0 |
| 32 | 0 | 0 | 0 | 0 | 0 | 0 | 1 | 0 | 0 | 0 | 0 | 0 |
| 33 | 1 | 0 | 0 | 0 | 0 | 0 | 1 | 1 | 0 | 0 | 0 | 0 |
| 34 | 1 | 1 | 0 | 0 | 0 | 0 | 1 | 1 | 0 | 0 | 0 | 0 |
| 35 | 1 | 1 | 1 | 0 | 0 | 0 | 1 | 1 | 0 | 0 | 0 | 0 |
| 36 | 0 | 0 | 0 | 1 | 0 | 0 | 1 | 1 | 0 | 0 | 0 | 0 |
| 37 | 1 | 0 | 0 | 1 | 0 | 0 | 1 | 1 | 0 | 0 | 0 | 0 |

TABLE 4-2

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 38 | 1 | 1 | 0 | 1 | 0 | 0 | 1 | 1 | 0 | 0 | 0 | 0 |
| 39 | 1 | 1 | 1 | 1 | 0 | 0 | 1 | 1 | 0 | 0 | 0 | 0 |
| 40 | 0 | 0 | 0 | 1 | 1 | 0 | 1 | 1 | 0 | 0 | 0 | 0 |
| 41 | 1 | 0 | 0 | 1 | 1 | 0 | 1 | 1 | 0 | 0 | 0 | 0 |
| 42 | 1 | 1 | 0 | 1 | 1 | 0 | 1 | 1 | 0 | 0 | 0 | 0 |
| 43 | 1 | 1 | 1 | 1 | 1 | 0 | 1 | 1 | 0 | 0 | 0 | 0 |
| 44 | 0 | 0 | 0 | 1 | 1 | 1 | 1 | 1 | 0 | 0 | 0 | 0 |
| 45 | 1 | 0 | 0 | 1 | 1 | 1 | 1 | 1 | 0 | 0 | 0 | 0 |
| 46 | 1 | 1 | 0 | 1 | 1 | 1 | 1 | 1 | 0 | 0 | 0 | 0 |
| 47 | 1 | 1 | 1 | 1 | 1 | 1 | 1 | 1 | 0 | 0 | 0 | 0 |
| 48 | 0 | 0 | 0 | 0 | 0 | 0 | 1 | 1 | 1 | 0 | 0 | 0 |
| 49 | 1 | 0 | 0 | 0 | 0 | 0 | 1 | 1 | 1 | 0 | 0 | 0 |
| 50 | 1 | 1 | 0 | 0 | 0 | 0 | 1 | 1 | 1 | 0 | 0 | 0 |
| 51 | 1 | 1 | 1 | 0 | 0 | 0 | 1 | 1 | 1 | 0 | 0 | 0 |
| 52 | 0 | 0 | 0 | 1 | 0 | 0 | 1 | 1 | 1 | 0 | 0 | 0 |
| 53 | 1 | 0 | 0 | 1 | 0 | 0 | 1 | 1 | 1 | 0 | 0 | 0 |
| 54 | 1 | 1 | 0 | 1 | 0 | 0 | 1 | 1 | 1 | 0 | 0 | 0 |
| 55 | 1 | 1 | 1 | 1 | 0 | 0 | 1 | 1 | 1 | 0 | 0 | 0 |
| 56 | 0 | 0 | 0 | 1 | 1 | 0 | 1 | 1 | 1 | 0 | 0 | 0 |
| 57 | 1 | 0 | 0 | 1 | 1 | 0 | 1 | 1 | 1 | 0 | 0 | 0 |
| 58 | 1 | 1 | 0 | 1 | 1 | 0 | 1 | 1 | 1 | 0 | 0 | 0 |
| 59 | 1 | 1 | 1 | 1 | 1 | 0 | 1 | 1 | 1 | 0 | 0 | 0 |
| 60 | 0 | 0 | 0 | 1 | 1 | 1 | 1 | 1 | 1 | 0 | 0 | 0 |
| 61 | 1 | 0 | 0 | 1 | 1 | 1 | 1 | 1 | 1 | 0 | 0 | 0 |
| 62 | 1 | 1 | 0 | 1 | 1 | 1 | 1 | 1 | 1 | 0 | 0 | 0 |
| 63 | 1 | 1 | 1 | 1 | 1 | 1 | 1 | 1 | 1 | 0 | 0 | 0 |
| 64 | 0 | 0 | 0 | 0 | 0 | 0 | 0 | 0 | 0 | 1 | 0 | 0 |
| 65 | 1 | 0 | 0 | 0 | 0 | 0 | 0 | 0 | 0 | 1 | 0 | 0 |
| 66 | 1 | 1 | 0 | 0 | 0 | 0 | 0 | 0 | 0 | 1 | 0 | 0 |
| 67 | 1 | 1 | 1 | 0 | 0 | 0 | 0 | 0 | 0 | 1 | 0 | 0 |
| 68 | 0 | 0 | 0 | 1 | 0 | 0 | 0 | 0 | 0 | 1 | 0 | 0 |
| 69 | 1 | 0 | 0 | 1 | 0 | 0 | 0 | 0 | 0 | 1 | 0 | 0 |
| 70 | 1 | 1 | 0 | 1 | 0 | 0 | 0 | 0 | 0 | 1 | 0 | 0 |
| 71 | 1 | 1 | 1 | 1 | 0 | 0 | 0 | 0 | 0 | 1 | 0 | 0 |
| 72 | 0 | 0 | 0 | 1 | 1 | 0 | 0 | 0 | 0 | 1 | 0 | 0 |
| 73 | 1 | 0 | 0 | 1 | 1 | 0 | 0 | 0 | 0 | 1 | 0 | 0 |
| 74 | 1 | 1 | 0 | 1 | 1 | 0 | 0 | 0 | 0 | 1 | 0 | 0 |
| 75 | 1 | 1 | 1 | 1 | 1 | 0 | 0 | 0 | 0 | 1 | 0 | 0 |
| 76 | 0 | 0 | 0 | 1 | 1 | 1 | 0 | 0 | 0 | 1 | 0 | 0 |

TABLE 4-3

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 77 | 1 | 0 | 0 | 1 | 1 | 1 | 0 | 0 | 0 | 1 | 0 | 0 |
| 78 | 1 | 1 | 0 | 1 | 1 | 1 | 0 | 0 | 0 | 1 | 0 | 0 |
| 79 | 1 | 1 | 1 | 1 | 1 | 1 | 0 | 0 | 0 | 1 | 0 | 0 |
| 80 | 0 | 0 | 0 | 0 | 0 | 0 | 1 | 0 | 0 | 1 | 0 | 0 |
| 81 | 1 | 0 | 0 | 0 | 0 | 0 | 1 | 0 | 0 | 1 | 0 | 0 |
| 82 | 1 | 1 | 0 | 0 | 0 | 0 | 1 | 0 | 0 | 1 | 0 | 0 |
| 83 | 1 | 1 | 1 | 0 | 0 | 0 | 1 | 0 | 0 | 1 | 0 | 0 |
| 84 | 0 | 0 | 0 | 1 | 0 | 0 | 1 | 0 | 0 | 1 | 0 | 0 |
| 85 | 1 | 0 | 0 | 1 | 0 | 0 | 1 | 0 | 0 | 1 | 0 | 0 |
| 86 | 1 | 1 | 0 | 1 | 0 | 0 | 1 | 0 | 0 | 1 | 0 | 0 |
| 87 | 1 | 1 | 1 | 1 | 0 | 0 | 1 | 0 | 0 | 1 | 0 | 0 |
| 88 | 0 | 0 | 0 | 1 | 1 | 0 | 1 | 0 | 0 | 1 | 0 | 0 |
| 89 | 1 | 0 | 0 | 1 | 1 | 0 | 1 | 0 | 0 | 1 | 0 | 0 |
| 90 | 1 | 1 | 0 | 1 | 1 | 0 | 1 | 0 | 0 | 1 | 0 | 0 |
| 91 | 1 | 1 | 1 | 1 | 1 | 0 | 1 | 0 | 0 | 1 | 0 | 0 |
| 92 | 0 | 0 | 0 | 1 | 1 | 1 | 1 | 0 | 0 | 1 | 0 | 0 |
| 93 | 1 | 0 | 0 | 1 | 1 | 1 | 1 | 0 | 0 | 1 | 0 | 0 |
| 94 | 1 | 1 | 0 | 1 | 1 | 1 | 1 | 0 | 0 | 1 | 0 | 0 |
| 95 | 1 | 1 | 1 | 1 | 1 | 1 | 1 | 0 | 0 | 1 | 0 | 0 |
| 96 | 0 | 0 | 0 | 0 | 0 | 0 | 1 | 1 | 0 | 1 | 0 | 0 |
| 97 | 1 | 0 | 0 | 0 | 0 | 0 | 1 | 1 | 0 | 1 | 0 | 0 |
| 98 | 1 | 1 | 0 | 0 | 0 | 0 | 1 | 1 | 0 | 1 | 0 | 0 |
| 99 | 1 | 1 | 1 | 0 | 0 | 0 | 1 | 1 | 0 | 1 | 0 | 0 |
| 100 | 0 | 0 | 0 | 1 | 0 | 0 | 1 | 1 | 0 | 1 | 0 | 0 |
| 101 | 1 | 0 | 0 | 1 | 0 | 0 | 1 | 1 | 0 | 1 | 0 | 0 |
| 102 | 1 | 1 | 0 | 1 | 0 | 0 | 1 | 1 | 0 | 1 | 0 | 0 |
| 103 | 1 | 1 | 1 | 1 | 0 | 0 | 1 | 1 | 0 | 1 | 0 | 0 |
| 104 | 0 | 0 | 0 | 1 | 1 | 0 | 1 | 1 | 0 | 1 | 0 | 0 |
| 105 | 1 | 0 | 0 | 1 | 1 | 0 | 1 | 1 | 0 | 1 | 0 | 0 |

TABLE 4-3-continued

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 106 | 1 | 1 | 0 | 1 | 1 | 0 | 1 | 1 | 0 | 1 | 0 | 0 |
| 107 | 1 | 1 | 1 | 1 | 1 | 0 | 1 | 1 | 0 | 1 | 0 | 0 |
| 108 | 0 | 0 | 0 | 1 | 1 | 1 | 1 | 1 | 0 | 1 | 0 | 0 |
| 109 | 1 | 0 | 0 | 1 | 1 | 1 | 1 | 1 | 0 | 1 | 0 | 0 |
| 110 | 1 | 1 | 0 | 1 | 1 | 1 | 1 | 1 | 0 | 1 | 0 | 0 |
| 111 | 1 | 1 | 1 | 1 | 1 | 1 | 1 | 1 | 0 | 1 | 0 | 0 |
| 112 | 0 | 0 | 0 | 0 | 0 | 0 | 1 | 1 | 1 | 1 | 0 | 0 |
| 113 | 1 | 0 | 0 | 0 | 0 | 0 | 1 | 1 | 1 | 1 | 0 | 0 |
| 114 | 1 | 1 | 0 | 0 | 0 | 0 | 1 | 1 | 1 | 1 | 0 | 0 |
| 115 | 1 | 1 | 1 | 0 | 0 | 0 | 1 | 1 | 1 | 1 | 0 | 0 |
| 116 | 0 | 0 | 0 | 1 | 0 | 0 | 1 | 1 | 1 | 1 | 0 | 0 |
| 117 | 1 | 0 | 0 | 1 | 0 | 0 | 1 | 1 | 1 | 1 | 0 | 0 |

TABLE 4-4

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 118 | 1 | 1 | 0 | 1 | 0 | 0 | 1 | 1 | 1 | 1 | 0 | 0 |
| 119 | 1 | 1 | 1 | 1 | 0 | 0 | 1 | 1 | 1 | 1 | 0 | 0 |
| 120 | 0 | 0 | 0 | 1 | 1 | 0 | 1 | 1 | 1 | 1 | 0 | 0 |
| 121 | 1 | 0 | 0 | 1 | 1 | 0 | 1 | 1 | 1 | 1 | 0 | 0 |
| 122 | 1 | 1 | 0 | 1 | 1 | 0 | 1 | 1 | 1 | 1 | 0 | 0 |
| 123 | 1 | 1 | 1 | 1 | 1 | 0 | 1 | 1 | 1 | 1 | 0 | 0 |
| 124 | 0 | 0 | 0 | 1 | 1 | 1 | 1 | 1 | 1 | 1 | 0 | 0 |
| 125 | 1 | 0 | 0 | 1 | 1 | 1 | 1 | 1 | 1 | 1 | 0 | 0 |
| 126 | 1 | 1 | 0 | 1 | 1 | 1 | 1 | 1 | 1 | 1 | 0 | 0 |
| 127 | 1 | 1 | 1 | 1 | 1 | 1 | 1 | 1 | 1 | 1 | 0 | 0 |
| 128 | 0 | 0 | 0 | 0 | 0 | 0 | 0 | 0 | 0 | 1 | 1 | 0 |
| 129 | 1 | 0 | 0 | 0 | 0 | 0 | 0 | 0 | 0 | 1 | 1 | 0 |
| 130 | 1 | 1 | 0 | 0 | 0 | 0 | 0 | 0 | 0 | 1 | 1 | 0 |
| 131 | 1 | 1 | 1 | 0 | 0 | 0 | 0 | 0 | 0 | 1 | 1 | 0 |
| 132 | 0 | 0 | 0 | 1 | 0 | 0 | 0 | 0 | 0 | 1 | 1 | 0 |
| 133 | 1 | 0 | 0 | 1 | 0 | 0 | 0 | 0 | 0 | 1 | 1 | 0 |
| 134 | 1 | 1 | 0 | 1 | 0 | 0 | 0 | 0 | 0 | 1 | 1 | 0 |
| 135 | 1 | 1 | 1 | 1 | 0 | 0 | 0 | 0 | 0 | 1 | 1 | 0 |
| 136 | 0 | 0 | 0 | 1 | 1 | 0 | 0 | 0 | 0 | 1 | 1 | 0 |
| 137 | 1 | 0 | 0 | 1 | 1 | 0 | 0 | 0 | 0 | 1 | 1 | 0 |
| 138 | 1 | 1 | 0 | 1 | 1 | 0 | 0 | 0 | 0 | 1 | 1 | 0 |
| 139 | 1 | 1 | 1 | 1 | 1 | 0 | 0 | 0 | 0 | 1 | 1 | 0 |
| 140 | 0 | 0 | 0 | 1 | 1 | 1 | 0 | 0 | 0 | 1 | 1 | 0 |
| 141 | 1 | 0 | 0 | 1 | 1 | 1 | 0 | 0 | 0 | 1 | 1 | 0 |
| 142 | 1 | 1 | 0 | 1 | 1 | 1 | 0 | 0 | 0 | 1 | 1 | 0 |
| 143 | 1 | 1 | 1 | 1 | 1 | 1 | 0 | 0 | 0 | 1 | 1 | 0 |
| 144 | 0 | 0 | 0 | 0 | 0 | 0 | 1 | 0 | 0 | 1 | 1 | 0 |
| 145 | 1 | 0 | 0 | 0 | 0 | 0 | 1 | 0 | 0 | 1 | 1 | 0 |
| 146 | 1 | 1 | 0 | 0 | 0 | 0 | 1 | 0 | 0 | 1 | 1 | 0 |
| 147 | 1 | 1 | 1 | 0 | 0 | 0 | 1 | 0 | 0 | 1 | 1 | 0 |
| 148 | 0 | 0 | 0 | 1 | 0 | 0 | 1 | 0 | 0 | 1 | 1 | 0 |
| 149 | 1 | 0 | 0 | 1 | 0 | 0 | 1 | 0 | 0 | 1 | 1 | 0 |
| 150 | 1 | 1 | 0 | 1 | 0 | 0 | 1 | 0 | 0 | 1 | 1 | 0 |
| 151 | 1 | 1 | 1 | 1 | 0 | 0 | 1 | 0 | 0 | 1 | 1 | 0 |
| 152 | 0 | 0 | 0 | 1 | 1 | 0 | 1 | 0 | 0 | 1 | 1 | 0 |
| 153 | 1 | 0 | 0 | 1 | 1 | 0 | 1 | 0 | 0 | 1 | 1 | 0 |
| 154 | 1 | 1 | 0 | 1 | 1 | 0 | 1 | 0 | 0 | 1 | 1 | 0 |
| 155 | 1 | 1 | 1 | 1 | 1 | 0 | 1 | 0 | 0 | 1 | 1 | 0 |
| 156 | 0 | 0 | 0 | 1 | 1 | 1 | 1 | 0 | 0 | 1 | 1 | 0 |
| 157 | 1 | 0 | 0 | 1 | 1 | 1 | 1 | 0 | 0 | 1 | 1 | 0 |
| 158 | 1 | 1 | 0 | 1 | 1 | 1 | 1 | 0 | 0 | 1 | 1 | 0 |

TABLE 4-5

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 159 | 1 | 1 | 1 | 1 | 1 | 1 | 1 | 0 | 0 | 1 | 1 | 0 |
| 160 | 0 | 0 | 0 | 0 | 0 | 0 | 1 | 1 | 0 | 1 | 1 | 0 |
| 161 | 1 | 0 | 0 | 0 | 0 | 0 | 1 | 1 | 0 | 1 | 1 | 0 |
| 162 | 1 | 1 | 0 | 0 | 0 | 0 | 1 | 1 | 0 | 1 | 1 | 0 |
| 163 | 1 | 1 | 1 | 0 | 0 | 0 | 1 | 1 | 0 | 1 | 1 | 0 |
| 164 | 0 | 0 | 0 | 1 | 0 | 0 | 1 | 1 | 0 | 1 | 1 | 0 |
| 165 | 1 | 0 | 0 | 1 | 0 | 0 | 1 | 1 | 0 | 1 | 1 | 0 |

TABLE 4-5-continued

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 166 | 1 | 1 | 0 | 1 | 0 | 0 | 1 | 1 | 0 | 1 | 1 | 0 |
| 167 | 1 | 1 | 1 | 1 | 0 | 0 | 1 | 1 | 0 | 1 | 1 | 0 |
| 168 | 0 | 0 | 0 | 1 | 1 | 0 | 1 | 1 | 0 | 1 | 1 | 0 |
| 169 | 1 | 0 | 0 | 1 | 1 | 0 | 1 | 1 | 0 | 1 | 1 | 0 |
| 170 | 1 | 1 | 0 | 1 | 1 | 0 | 1 | 1 | 0 | 1 | 1 | 0 |
| 171 | 1 | 1 | 1 | 1 | 1 | 0 | 1 | 1 | 0 | 1 | 1 | 0 |
| 172 | 0 | 0 | 0 | 1 | 1 | 1 | 1 | 1 | 0 | 1 | 1 | 0 |
| 173 | 1 | 0 | 0 | 1 | 1 | 1 | 1 | 1 | 0 | 1 | 1 | 0 |
| 174 | 1 | 1 | 0 | 1 | 1 | 1 | 1 | 1 | 0 | 1 | 1 | 0 |
| 175 | 1 | 1 | 1 | 1 | 1 | 1 | 1 | 1 | 0 | 1 | 1 | 0 |
| 176 | 0 | 0 | 0 | 0 | 0 | 0 | 1 | 1 | 1 | 1 | 1 | 0 |
| 177 | 1 | 0 | 0 | 0 | 0 | 0 | 1 | 1 | 1 | 1 | 1 | 0 |
| 178 | 1 | 1 | 0 | 0 | 0 | 0 | 1 | 1 | 1 | 1 | 1 | 0 |
| 179 | 1 | 1 | 1 | 0 | 0 | 0 | 1 | 1 | 1 | 1 | 1 | 0 |
| 180 | 0 | 0 | 0 | 1 | 0 | 0 | 1 | 1 | 1 | 1 | 1 | 0 |
| 181 | 1 | 0 | 0 | 1 | 0 | 0 | 1 | 1 | 1 | 1 | 1 | 0 |
| 182 | 1 | 1 | 0 | 1 | 0 | 0 | 1 | 1 | 1 | 1 | 1 | 0 |
| 183 | 1 | 1 | 1 | 1 | 0 | 0 | 1 | 1 | 1 | 1 | 1 | 0 |
| 184 | 0 | 0 | 0 | 1 | 1 | 0 | 1 | 1 | 1 | 1 | 1 | 0 |
| 185 | 1 | 0 | 0 | 1 | 1 | 0 | 1 | 1 | 1 | 1 | 1 | 0 |
| 186 | 1 | 1 | 0 | 1 | 1 | 0 | 1 | 1 | 1 | 1 | 1 | 0 |
| 187 | 1 | 1 | 1 | 1 | 1 | 0 | 1 | 1 | 1 | 1 | 1 | 0 |
| 188 | 0 | 0 | 0 | 1 | 1 | 1 | 1 | 1 | 1 | 1 | 1 | 0 |
| 189 | 1 | 0 | 0 | 1 | 1 | 1 | 1 | 1 | 1 | 1 | 1 | 0 |
| 190 | 1 | 1 | 0 | 1 | 1 | 1 | 1 | 1 | 1 | 1 | 1 | 0 |
| 191 | 1 | 1 | 1 | 1 | 1 | 1 | 1 | 1 | 1 | 1 | 1 | 0 |
| 192 | 0 | 0 | 0 | 0 | 0 | 0 | 0 | 0 | 0 | 1 | 1 | 1 |
| 193 | 1 | 0 | 0 | 0 | 0 | 0 | 0 | 0 | 0 | 1 | 1 | 1 |
| 194 | 1 | 1 | 0 | 0 | 0 | 0 | 0 | 0 | 0 | 1 | 1 | 1 |
| 195 | 1 | 1 | 1 | 0 | 0 | 0 | 0 | 0 | 0 | 1 | 1 | 1 |
| 196 | 0 | 0 | 0 | 1 | 0 | 0 | 0 | 0 | 0 | 1 | 1 | 1 |
| 197 | 1 | 0 | 0 | 1 | 0 | 0 | 0 | 0 | 0 | 1 | 1 | 1 |
| 198 | 1 | 1 | 0 | 1 | 0 | 0 | 0 | 0 | 0 | 1 | 1 | 1 |

TABLE 4-6

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 199 | 1 | 1 | 1 | 1 | 0 | 0 | 0 | 0 | 0 | 1 | 1 | 1 |
| 200 | 0 | 0 | 0 | 1 | 1 | 0 | 0 | 0 | 0 | 1 | 1 | 1 |
| 201 | 1 | 0 | 0 | 1 | 1 | 0 | 0 | 0 | 0 | 1 | 1 | 1 |
| 202 | 1 | 1 | 0 | 1 | 1 | 0 | 0 | 0 | 0 | 1 | 1 | 1 |
| 203 | 1 | 1 | 1 | 1 | 1 | 0 | 0 | 0 | 0 | 1 | 1 | 1 |
| 204 | 0 | 0 | 0 | 1 | 1 | 1 | 0 | 0 | 0 | 1 | 1 | 1 |
| 205 | 1 | 0 | 0 | 1 | 1 | 1 | 0 | 0 | 0 | 1 | 1 | 1 |
| 206 | 1 | 1 | 0 | 1 | 1 | 1 | 0 | 0 | 0 | 1 | 1 | 1 |
| 207 | 1 | 1 | 1 | 1 | 1 | 1 | 0 | 0 | 0 | 1 | 1 | 1 |
| 208 | 0 | 0 | 0 | 0 | 0 | 0 | 1 | 0 | 0 | 1 | 1 | 1 |
| 209 | 1 | 0 | 0 | 0 | 0 | 0 | 1 | 0 | 0 | 1 | 1 | 1 |
| 210 | 1 | 1 | 0 | 0 | 0 | 0 | 1 | 0 | 0 | 1 | 1 | 1 |
| 211 | 1 | 1 | 1 | 0 | 0 | 0 | 1 | 0 | 0 | 1 | 1 | 1 |
| 212 | 0 | 0 | 0 | 1 | 0 | 0 | 1 | 0 | 0 | 1 | 1 | 1 |
| 213 | 1 | 0 | 0 | 1 | 0 | 0 | 1 | 0 | 0 | 1 | 1 | 1 |
| 214 | 1 | 1 | 0 | 1 | 0 | 0 | 1 | 0 | 0 | 1 | 1 | 1 |
| 215 | 1 | 1 | 1 | 1 | 0 | 0 | 1 | 0 | 0 | 1 | 1 | 1 |
| 216 | 0 | 0 | 0 | 1 | 1 | 0 | 1 | 0 | 0 | 1 | 1 | 1 |
| 217 | 1 | 0 | 0 | 1 | 1 | 0 | 1 | 0 | 0 | 1 | 1 | 1 |
| 218 | 1 | 1 | 0 | 1 | 1 | 0 | 1 | 0 | 0 | 1 | 1 | 1 |
| 219 | 1 | 1 | 1 | 1 | 1 | 0 | 1 | 0 | 0 | 1 | 1 | 1 |
| 220 | 0 | 0 | 0 | 1 | 1 | 1 | 1 | 0 | 0 | 1 | 1 | 1 |
| 221 | 1 | 0 | 0 | 1 | 1 | 1 | 1 | 0 | 0 | 1 | 1 | 1 |
| 222 | 1 | 1 | 0 | 1 | 1 | 1 | 1 | 0 | 0 | 1 | 1 | 1 |
| 223 | 1 | 1 | 1 | 1 | 1 | 1 | 1 | 0 | 0 | 1 | 1 | 1 |
| 224 | 0 | 0 | 0 | 0 | 0 | 0 | 1 | 1 | 0 | 1 | 1 | 1 |
| 225 | 1 | 0 | 0 | 0 | 0 | 0 | 1 | 1 | 0 | 1 | 1 | 1 |
| 226 | 1 | 1 | 0 | 0 | 0 | 0 | 1 | 1 | 0 | 1 | 1 | 1 |
| 227 | 1 | 1 | 1 | 0 | 0 | 0 | 1 | 1 | 0 | 1 | 1 | 1 |
| 228 | 0 | 0 | 0 | 1 | 0 | 0 | 1 | 1 | 0 | 1 | 1 | 1 |
| 229 | 1 | 0 | 0 | 1 | 0 | 0 | 1 | 1 | 0 | 1 | 1 | 1 |
| 230 | 1 | 1 | 0 | 1 | 0 | 0 | 1 | 1 | 0 | 1 | 1 | 1 |
| 231 | 1 | 1 | 1 | 1 | 0 | 0 | 1 | 1 | 0 | 1 | 1 | 1 |
| 232 | 0 | 0 | 0 | 1 | 1 | 0 | 1 | 1 | 0 | 1 | 1 | 1 |

TABLE 4-6-continued

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 233 | 1 | 0 | 0 | 1 | 1 | 0 | 1 | 1 | 0 | 1 | 1 | 1 |
| 234 | 1 | 1 | 0 | 1 | 1 | 0 | 1 | 1 | 0 | 1 | 1 | 1 |

TABLE 4-7

| Gray Level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 235 | 1 | 1 | 1 | 1 | 1 | 0 | 1 | 1 | 0 | 1 | 1 | 1 |
| 236 | 0 | 0 | 0 | 1 | 1 | 1 | 1 | 1 | 0 | 1 | 1 | 1 |
| 237 | 1 | 0 | 0 | 1 | 1 | 1 | 1 | 1 | 0 | 1 | 1 | 1 |
| 238 | 1 | 1 | 0 | 1 | 1 | 1 | 1 | 1 | 0 | 1 | 1 | 1 |
| 239 | 1 | 1 | 1 | 1 | 1 | 1 | 1 | 1 | 0 | 1 | 1 | 1 |
| 240 | 0 | 0 | 0 | 0 | 0 | 0 | 1 | 1 | 1 | 1 | 1 | 1 |
| 241 | 1 | 0 | 0 | 0 | 0 | 0 | 1 | 1 | 1 | 1 | 1 | 1 |
| 242 | 1 | 1 | 0 | 0 | 0 | 0 | 1 | 1 | 1 | 1 | 1 | 1 |
| 243 | 1 | 1 | 1 | 0 | 0 | 0 | 1 | 1 | 1 | 1 | 1 | 1 |
| 244 | 0 | 0 | 0 | 1 | 0 | 0 | 1 | 1 | 1 | 1 | 1 | 1 |
| 245 | 1 | 0 | 0 | 1 | 0 | 0 | 1 | 1 | 1 | 1 | 1 | 1 |
| 246 | 1 | 1 | 0 | 1 | 0 | 0 | 1 | 1 | 1 | 1 | 1 | 1 |
| 247 | 1 | 1 | 1 | 1 | 0 | 0 | 1 | 1 | 1 | 1 | 1 | 1 |
| 248 | 0 | 0 | 0 | 1 | 1 | 0 | 1 | 1 | 1 | 1 | 1 | 1 |
| 249 | 1 | 0 | 0 | 1 | 1 | 0 | 1 | 1 | 1 | 1 | 1 | 1 |
| 250 | 1 | 1 | 0 | 1 | 1 | 0 | 1 | 1 | 1 | 1 | 1 | 1 |
| 251 | 1 | 1 | 1 | 1 | 1 | 0 | 1 | 1 | 1 | 1 | 1 | 1 |
| 252 | 0 | 0 | 0 | 1 | 1 | 1 | 1 | 1 | 1 | 1 | 1 | 1 |
| 253 | 1 | 0 | 0 | 1 | 1 | 1 | 1 | 1 | 1 | 1 | 1 | 1 |
| 254 | 1 | 1 | 0 | 1 | 1 | 1 | 1 | 1 | 1 | 1 | 1 | 1 |
| 255 | 1 | 1 | 1 | 1 | 1 | 1 | 1 | 1 | 1 | 1 | 1 | 1 |

As can be seen from Table 4-1 to Table 4-7, in the plasma display driving method according to the second embodiment of the present invention, total 256 gray level values from 0 until 255 gray level can be expressed continuously. The selective erasing sub-fields ESF express gray level values by the linear coding permitting a gray level expression only when the previous sub-field has been necessarily turned on. In other words, the off-cells selected at the second sub-field SF2, the third sub-field SF3, the fifth sub-field SF5, the sixth sub-field SF6, the eighth sub-field SF8, the ninth sub-field SF9, the eleventh sub-field SF11 and the twelfth sub-field SF12 are selected from the discharge cells that are kept into the on-cell a the previous sub-field. Accordingly, the selective erasing sub-field ESF does not require a reset period for initializing the entire field or a full writing discharge.

In the plasma display driving method according to the second embodiment of the present invention, the address period 9.6 ms to thereby assure more sustain period to that extent. Herein, the address period is a sum of 5.76 ms calculated by 3 μs (a pulse width of the selective writing scanning pulse)×480 lines×4 (the number of selective writing sub-fields) with 3.84 ms calculated by 1 μs (a pulse width of the selective erasing scanning pulse)×480 lines×8 (the number of selective erasing sub-fields) per frame.

Furthermore, the plasma display driving method according to the second embodiment of the present invention can assure the sustain period even when one frame is configured by 12 sub-fields because the erase period is omitted.

Moreover, the plasma display driving method according to the second embodiment of the present invention can enhance a contrast ratio as the full writing interval is omitted from the selective erasing sub-field ESF.

A driving waveform required for the plasma display driving method according to the second embodiment of the present invention can use the driving waveform as shown in FIG. 6.

The sub-field arrangement as indicated in Table 4-1 to Table 4-7 may be differentiated on a frame-by-frame basis. For instance, the kth frame and the (k+1)th frame (wherein k is an integer) may have the number of sub-fields and a brightness weighting value that are set differently.

The following Table 5 represents a brightness weighting value assigned for each sub-field at the kth frame and the (k+1)th frame by the decimal number.

TABLE 5

| | Sub-field | | | | | | | | | |
|---|---|---|---|---|---|---|---|---|---|---|
| | SF1 | SF2 | SF3 | SF4 | SF5 | SF6 | SF7 | SF8 | SF9 | SF10 |
| Brightness Weighting Value at Kth Frame | 2 | 8 | 16 | 32 | 32 | 32 | 32 | 32 | 32 | 32 |
| Brightness Weighting | 4 | 16 | 16 | 32 | 32 | 32 | 32 | 32 | 32 | 32 |

TABLE 5-continued

| | Sub-field | | | | | | | | | |
|---|---|---|---|---|---|---|---|---|---|---|
| | SF1 | SF2 | SF3 | SF4 | SF5 | SF6 | SF7 | SF8 | SF9 | SF10 |
| Value at (k + 1)th Frame | | | | | | | | | | |

As can be seen from Table 5, at each of the kth frame and the (k+1)th frame, brightness weighting values of the first and second sub-fields SF1 and SF2 are differentiated and hence the sustain period and the sustain discharge frequency are differentiated.

In the sub-field arrangement in the above Table 5, assuming that the first to fifth sub-fields SF1 to SF5 should be the selective writing sub-field WSF while the sixth to tenth sub-fields SF6 to SF10 should be the selective erasing sub-field ESF, the first to fourth sub-fields SF1 to SF4 are subject to the binary coding. On the other hand, the fifth to tenth sub-fields SF5 to SF10 are subject to the linear coding.

Such a gray level expression makes use of a fact that a brightness value expressed at each of the kth frame and the (k+1)th frame is subject to an integration to be viewed by an observer.

This will be described in detail in conjunction with the following Table 6-1 and Table 6-2, which represent a gray level value expression of 0 through 32 and 64.

TABLE 6-1

| Gray | | Sub-field | | | | | | | | | |
|---|---|---|---|---|---|---|---|---|---|---|---|
| Level | Frame | SF1 | SF2 | SF3 | SF4 | SF5 | SF6 | SF7 | SF8 | SF9 | SF10 |
| 0 | k | X | X | X | X | X | X | X | X | X | X |
| | K + 1 | X | X | X | X | X | X | X | X | X | X |
| 1 | k | ○ | X | X | X | X | X | X | X | X | X |
| | K + 1 | X | X | X | X | X | X | X | X | X | X |
| 2 | k | X | X | X | X | X | X | X | X | X | X |
| | K + 1 | ○ | X | X | X | X | X | X | X | X | X |
| 3 | k | ○ | X | X | X | X | X | X | X | X | X |
| | K + 1 | ○ | X | X | X | X | X | X | X | X | X |
| 4 | k | X | ○ | X | X | X | X | X | X | X | X |
| | K + 1 | X | X | X | X | X | X | X | X | X | X |
| 5 | k | ○ | ○ | X | X | X | X | X | X | X | X |
| | K + 1 | X | X | X | X | X | X | X | X | X | X |
| 6 | k | X | ○ | X | X | X | X | X | X | X | X |
| | K + 1 | ○ | X | X | X | X | X | X | X | X | X |
| 7 | k | ○ | ○ | X | X | X | X | X | X | X | X |
| | K + 1 | ○ | X | X | X | X | X | X | X | X | X |
| 8 | k | X | X | X | X | X | X | X | X | X | X |
| | K + 1 | X | ○ | X | X | X | X | X | X | X | X |
| 9 | k | ○ | X | X | X | X | X | X | X | X | X |
| | K + 1 | X | ○ | X | X | X | X | X | X | X | X |
| 10 | k | X | X | X | X | X | X | X | X | X | X |
| | K + 1 | ○ | ○ | X | X | X | X | X | X | X | X |
| 11 | k | ○ | X | X | X | X | X | X | X | X | X |
| | K + 1 | ○ | ○ | X | X | X | X | X | X | X | X |
| 12 | k | X | ○ | X | X | X | X | X | X | X | X |
| | K + 1 | X | ○ | X | X | X | X | X | X | X | X |
| 13 | k | ○ | ○ | X | X | X | X | X | X | X | X |
| | K + 1 | X | ○ | X | X | X | X | X | X | X | X |
| 14 | k | X | ○ | X | X | X | X | X | X | X | X |
| | K + 1 | ○ | ○ | X | X | X | X | X | X | X | X |
| 15 | k | ○ | ○ | X | X | X | X | X | X | X | X |
| | K + 1 | ○ | ○ | X | X | X | X | X | X | X | X |
| 16 | k | X | X | ○ | X | X | X | X | X | X | X |
| | K + 1 | X | X | ○ | X | X | X | X | X | X | X |
| 17 | k | ○ | X | ○ | X | X | X | X | X | X | X |
| | K + 1 | X | X | ○ | X | X | X | X | X | X | X |
| 18 | k | X | X | ○ | X | X | X | X | X | X | X |
| | K + 1 | ○ | X | ○ | X | X | X | X | X | X | X |

TABLE 6-2

| Gray | | Sub-field | | | | | | | | | |
|---|---|---|---|---|---|---|---|---|---|---|---|
| Level | Frame | SF1 | SF2 | SF3 | SF4 | SF5 | SF6 | SF7 | SF8 | SF9 | SF10 |
| 19 | k | ○ | X | ○ | X | X | X | X | X | X | X |
| | K + 1 | ○ | X | ○ | X | X | X | X | X | X | X |
| 20 | k | X | ○ | ○ | X | X | X | X | X | X | X |
| | K + 1 | X | X | ○ | X | X | X | X | X | X | X |
| 21 | k | ○ | ○ | ○ | X | X | X | X | X | X | X |
| | K + 1 | X | X | ○ | X | X | X | X | X | X | X |
| 22 | k | X | ○ | ○ | X | X | X | X | X | X | X |
| | K + 1 | ○ | X | ○ | X | X | X | X | X | X | X |
| 23 | k | ○ | ○ | ○ | X | X | X | X | X | X | X |
| | K + 1 | ○ | X | ○ | X | X | X | X | X | X | X |
| 24 | k | X | X | ○ | X | X | X | X | X | X | X |
| | K + 1 | X | ○ | ○ | X | X | X | X | X | X | X |
| 25 | k | ○ | X | ○ | X | X | X | X | X | X | X |
| | K + 1 | X | ○ | ○ | X | X | X | X | X | X | X |
| 26 | k | X | X | ○ | X | X | X | X | X | X | X |
| | K + 1 | ○ | ○ | ○ | X | X | X | X | X | X | X |
| 27 | k | ○ | X | ○ | X | X | X | X | X | X | X |
| | K + 1 | ○ | ○ | ○ | X | X | X | X | X | X | X |
| 28 | k | X | ○ | ○ | X | X | X | X | X | X | X |
| | K + 1 | X | ○ | ○ | X | X | X | X | X | X | X |
| 29 | k | ○ | ○ | ○ | X | X | X | X | X | X | X |
| | K + 1 | X | ○ | ○ | X | X | X | X | X | X | X |
| 30 | k | X | ○ | ○ | X | X | X | X | X | X | X |
| | K + 1 | ○ | ○ | ○ | X | X | X | X | X | X | X |
| 31 | k | ○ | ○ | ○ | X | X | X | X | X | X | X |
| | K + 1 | ○ | ○ | ○ | X | X | X | X | X | X | X |
| 32 | k | X | X | X | ○ | X | X | X | X | X | X |
| | K + 1 | X | X | X | ○ | X | X | X | X | X | X |
| 64 | k | X | X | X | ○ | ○ | X | X | X | X | X |
| | K + 1 | X | X | X | ○ | ○ | X | X | X | X | X |

As can be seen from Table 6-1, the discharge cell for expressing a gray level value '1' is selected into an on-cell only at the first sub-field SF1 of the kth frame while being selected into an off-cell at all the remaining sub-fields of the kth frame and the (k+1)th frame. In this case, an observer views a picture at a brightness corresponding to a brightness weighting value '2' in a sum interval of the kth frame and the (k+1)th frame. As a result, an observer views a picture at a brightness corresponding to a gray level value '1' by an integration effect.

Likewise, a gray level value '16' is selected into an on-cell only at the third sub-field SF3 of the kth frame and the (k+1)th frame each of which has a brightness weighting value of '16' while being selected into an off-cell at the remaining sub-fields. The discharge cell corresponding to a gray level value '33' having not described in Table 6-1 and Table 6-2 is selected into an on-cell at the first sub-field SF1 of the kth frame that has a brightness weighting value of '2' and at the kth frame that has a brightness weighting value '32' and only the fourth sub-field SF4 of the (k+1)th frame is turned on, whereas it is selected into an off-cell at the remaining sub-fields.

Accordingly, the plasma display driving method according to the third embodiment of the present invention can not only more reduce the address period, but also it can continuously express 256 gray levels using an integration effect of two frames. Furthermore, the plasma display driving method according to the third embodiment of the present invention can not only reduce the number of sub-fields, but also it can express a natural image. More specifically, the prior art requires at least four sub-fields so as to express total 16 gray levels from 0 until 15. On the other hand, in the plasma display driving method according to the third embodiment of the present invention, total 16 gray levels from 0 until 15 are expressed only two sub-fields by giving a different brightness weighting value to two frame and making use of an integration effect of these two frames.

A driving time and a contrast in the plasma display driving method according to the third embodiment of the present invention are as follows.

When the plasma display has a resolution of VGA class, a time required for the address period is merely 8.64 ms. As the address period is reduced, the sustain period can be sufficiently assured as 6.43 ms. Herein, the address period is a sum of 5.76 ms calculated by 3 μs (a pulse width of the selective writing scanning pulse)×480 lines×4 (the number of selective writing sub-fields) with 2.88 ms calculated by 1 μs (a pulse width of the selective erasing scanning pulse)×480 lines×6 (the number of selective erasing sub-fields) per frame. The sustain period is a time value (i.e., 16.67 ms−8.64 ms−0.3 ms−1 ms−0.3 ms) obtained by subtracting an address period of 8.64 ms, once reset period of 0.3 ms, an erase period of 100 μs×3 (the number of sub-fields)=0.3 ms and an extra time of the vertical synchronizing signal Vsync of 1 ms from one frame period of 16.67 ms per frame.

If the entire field continues to be turned on in the sustain period of 6.43 ms, then a light of about 640 cd/m$^2$ corresponding to a brightness of the peak white is produced. On the other hand, if the field is turned on only in once reset period within one frame, then a light of about 0.7 cd/m$^2$ corresponding to a black is produced. Accordingly, a darkroom contrast ratio in the plasma display driving method according to the third embodiment of the present invention is a level of 910:1.

FIG. 9 to FIG. 12 show a plasma display driving apparatus according to an embodiment of the present invention. In FIG. 9 to FIG. 12, the plasma display driving apparatus will be described in conjunction with FIG. 6 and FIG. 7 that show a driving waveform according to the first embodiment of the present invention.

Figure 9:
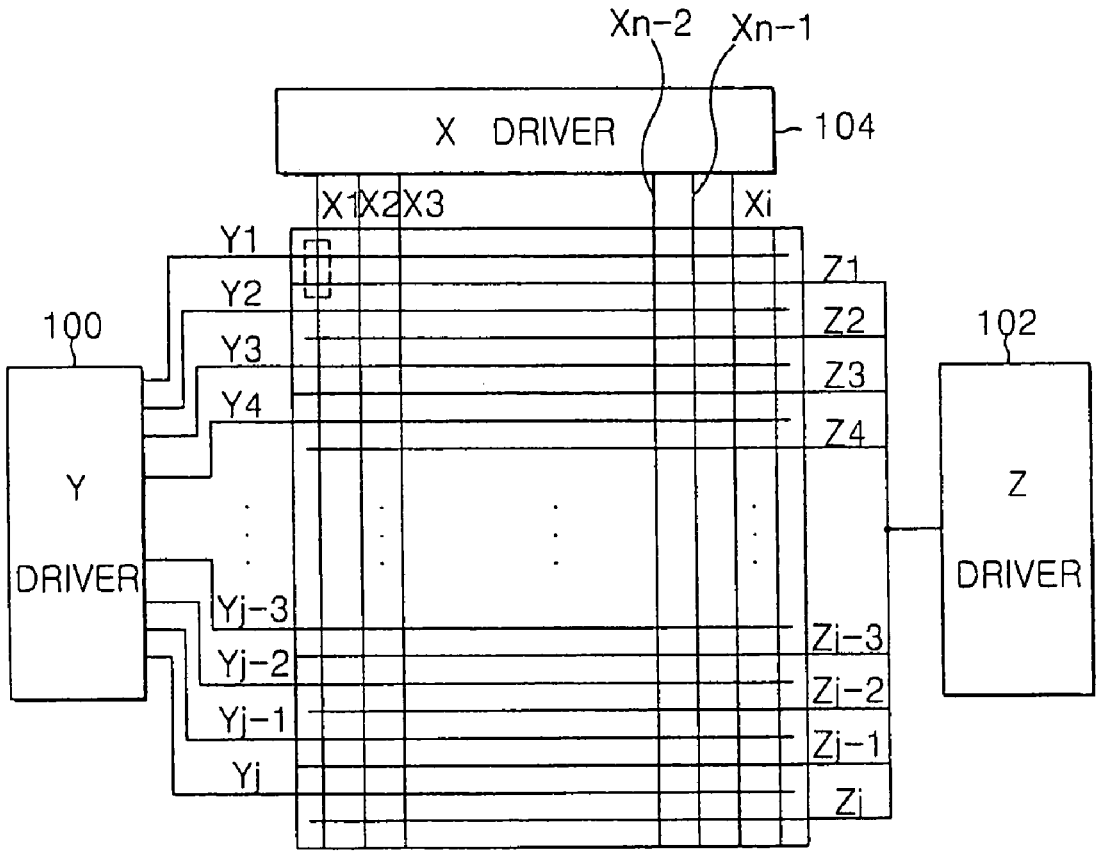
FIG. 9 is a schematic block diagram showing a configuration of a driving apparatus for a plasma display according to an embodiment of the present invention.

Referring to FIG. 9, the plasma display driving apparatus includes a Y driver 100 for driving j scan electrodes Y1 to Yj (wherein j is an integer), a Z driver 102 for driving j sustain electrodes Z1 to Zj, and a X driver 104 for driving i address electrodes X1 to Xi (wherein i is an integer larger than j).

The Y driver 100 continuously applies a set-up waveform RPSU and a set-down waveform RPSD in the reset period of the selective writing sub-field WSF to thereby initialize the entire field, and sequentially applies different scanning pulses SWSCN and SESCN to the scan electrodes Y1 to Yj in the address periods of the selective writing sub-field WSF and the selective erasing sub-field ESF. Further, the Y driver 100 applies sustaining pulses WISUS1, NSUS2, NSUS4, NSUS5, NSUS7 and WFSUS at the selective writing sub-field WSF and the selective erasing sub-field ESF to thereby causes a sustain discharge.

The Z driver 102 is commonly connected to the sustain electrodes Z1 to Zj. The Z driver 102 continuously applies the first direct current (DC) bias voltage DCbias1 and the second direct current (DC) bias voltage DCbias2 to the Z electrodes Z1 and Zj in the reset period and the address period of the selective writing sub-field WSF, and keeps a voltage on the sustain electrodes Z1 to Zj at 0V or a ground voltage GND in the reset period and the address period of the selective erasing sub-field ESF. Further, the Z driver 102 applies sustaining pulses WISUS2, NSUS1, NSUS3, NSUS6 and NSUS8 at the selective writing sub-field WSF and the selective erasing sub-field ESF to thereby causes a sustain discharge.

The X driver 104 applies a writing data pulse SWD or an erasing data pulse SED to the address electrodes X1 to Xi in such a manner to be synchronized with the scanning pulses SWSCN and SESCN in the reset period and the address period of the selective writing sub-field WSF.

Figure 10:
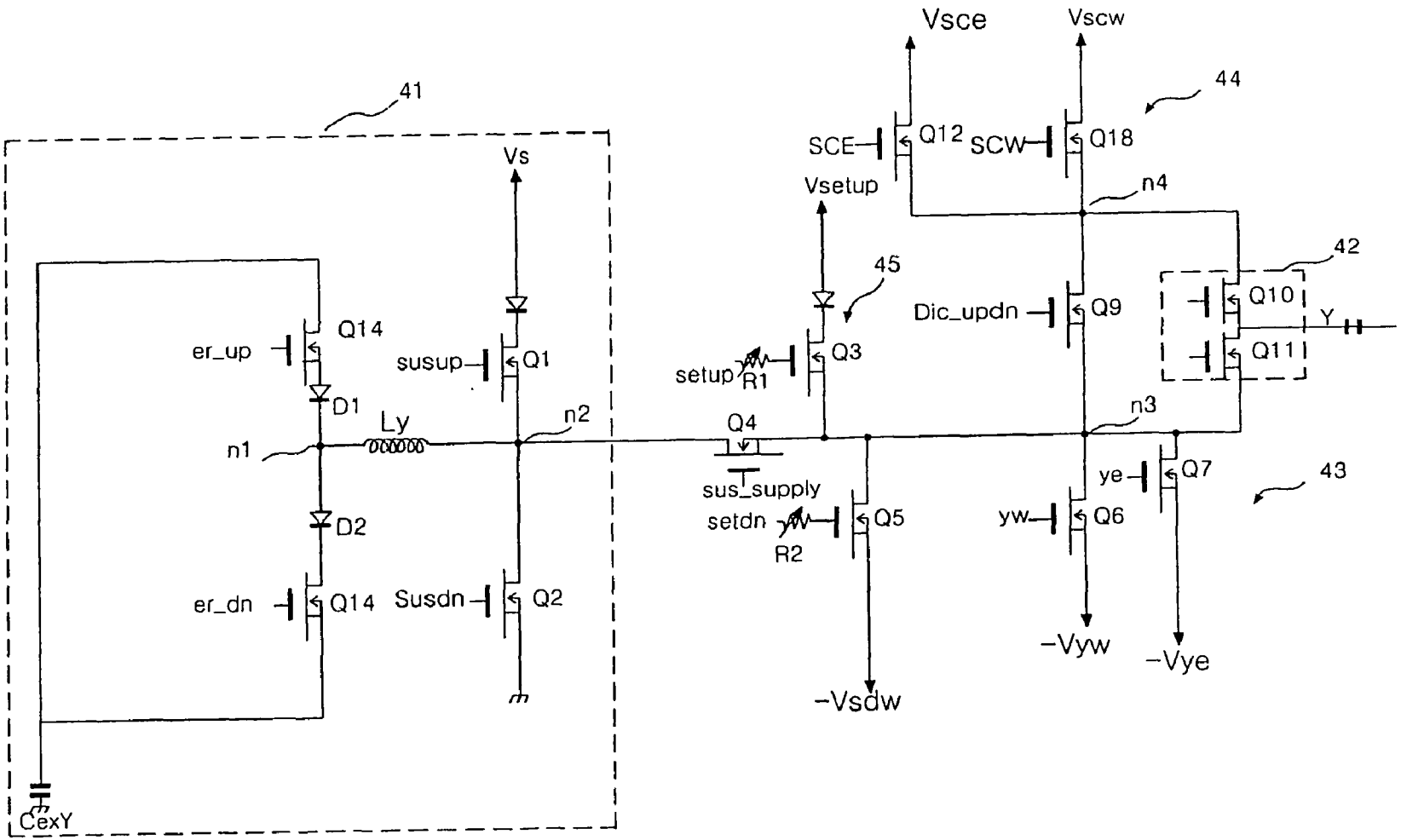
FIG. 10 is a detailed circuit diagram of the Y driver shown in FIG. 9.

FIG. 10 shows the Y driver in detail for the purpose of explaining a configuration and an operation of the Y driver 100.

Referring to FIG. 10, the Y driver 100 includes a fourth switch Q4 connected between an energy recovery circuit 41 and a drive integrated circuit (IC) 42, a negative scan voltage supply 43 and a scan reference voltage supply 44 connected to the fourth switch Q4 and the drive IC 42 to generate scanning pulses −SWSCN and −SESCN, respectively, and a set-up supplier 45 and a set-down supplier 46 connected among the fourth switch Q4, the negative scan voltage supply 43 and the scan reference voltage supply 44 to generate a set-up waveform RPSU and a set-down waveform RPSD.

The drive IC 42 is comprised of tenth and eleventh switches Q10 and Q11 that are connected in a push-pull shape and supplied with a voltage signal from the energy recovery circuit 41, the scan voltage supply 43 and the scan reference voltage supply. An output line between the tens and eleventh switches Q10 and Q11 is connected to any one of the scan electrodes Y1 to Ym.

The energy recovery circuit 41 includes an external capacitor CexY for charging an energy recovered from the scan electrodes Y1 to Ym, switches Q14 and Q15 connected, in parallel, to the external capacitor CexY, an inductor Ly connected between the first node n1 and the second node n2, the first switch Q1 connected between a sustain voltage source Vs and the second node n2, and the second switch Q2 connected between the second node n2 and a ground voltage terminal GND.

An operation of the energy recovery circuit 41 will be described below.

First, it is assumed that a voltage Vs/2 have been charged in the external capacitor CexY. If a fourteenth switch Q14 is turned on, a voltage charged in the external capacitor CexY is applied, via the fourteenth switch Q14, the first diode D1, the inductor Ly and the fourth switch Q4, to the drive IC 42 and then applied, via an internal diode (not shown) of the drive IC 42, to the scan electrodes Y1 to Ym. At this time, since the inductor Ly configures an LC resonance circuit along with a capacitance C of the discharge cell of the plasma display, a resonant waveform is applied to the scan electrodes Y1 to Ym. The first switch Q1 is turned on at a resonance point of the resonant waveform. If the first switch Q1 is turned on, a sustain voltage Vs is applied, via the first switch Q1 and the drive IC 42, to the scan electrodes Y1 to Ym. The sustain voltage Vs allows voltage levels on the sustain electrodes Y1 to Ym to be kept at the sustain voltage Vs. After a desired time, the first switch Q1 is turned off while a fifteenth switch Q15 is turned on. A reactive power, that is, an energy having not contributed to a discharge is applied, via the scan electrodes Y1 to Ym, the drive IC 42, the fourth switch Q4, the second diode D2 and the fifteenth switch Q15, to the external capacitor CexY. In other words, an energy is recovered from the plasma display into the external capacitor CexY. Subsequently, if the fifteenth switch Q15 is turned off and the second switch Q2 is turned on, then voltages on the scan electrodes Y1 to Ym keep 0V or a ground voltage GND.

During a time period when the voltages on the scan electrodes Y1 to Ym are charged and discharged by such an operation of the energy recovery circuit 41, the fourth switch Q4 keeps an ON state so as to form a current path between the energy recovery circuit 41 and the drive IC 42.

The energy recovery circuit 41 recovers an energy from the plasma display in this manner and then supplies the scan electrodes Y1 to Ym with the sustain voltage Vs using the recovered energy, thereby reducing excessive power consumption upon discharge in the set-up interval and the sustain period.

The negative scan voltage supply 43 is comprised of a sixth switch Q6 connected between a third node n3 and a writing scan voltage source −Vyw, and a seventh switch Q7 connected between the third node n3 and the erasing scan voltage source −Vye. The sixth switch Q6 is switched in response to a control signal yw supplied from a timing controller (not shown) during the address period of the selective writing sub-field WSF, thereby applying a writing scan voltage −Vyw to the drive IC 42. The seventh switch Q7 is switched in response to a control signal ye supplied from the timing controller (not shown) during the selective erasing sub-field ESF, thereby applying an erasing scan voltage −Vye to the drive IC 42.

The scan reference voltage supply 44 is comprised of an eighth switch Q8 connected between a writing scan reference voltage source Vscw and a fourth node n4, and a twelfth switch Q12 connected between an erasing scan reference voltage source Vsce and the fourth node n4. The eighth switch Q8 is switched in response to a control signal SCW supplied from the timing controller (not shown) during the address period of the selective writing sub-field WSF, thereby applying a writing scan reference voltage Vscw to the drive IC 42. The twelfth switch Q12 is switched in response to a control signal SCE supplied from the timing controller (not shown) during the address period of the selective erasing sub-field ESF, thereby applying an erasing scan reference voltage Vsce to the drive IC 42.

Alternatively, a scan reference voltage may be set equally at the selective writing sub-field WSF and the selective erasing sub-field ESF. In this case, any one of the scan voltage sources Vscw and Vsce and any one of the eighth and twelfth switches Q8 and Q12 may be omitted.

The set-up supplier 45 is comprised of a fourth diode D4 and a third switch Q3 that are connected between a set-up voltage source Vsetup and the third node n3. The fourth diode D4 shuts off a backward current flowing from the third node n3 into the set-up voltage source Vsetup. The third switch Q3 is switched in response to a control signal from the timing controller (not shown) during the reset period of the selective writing sub-field WSF, thereby applying a rising ramp waveform RPSU a slope of which is determined by a time constant value R1C to the third node n3. The rising ramp waveform RPSU generated at this time is applied, via the drive IC 42, to the scan electrodes Y1 to Yj, thereby raising a voltage on the scan electrode Y into a set-up voltage Vsetup.

The set-down supplier 46 is comprised of a fifth switch Q5 connected between the third node n3 and a set-down voltage source −Vsdw. The fifth switch Q5 is switched in response to a control signal setdn from the timing controller (not shown) after the ramp waveform RPSU with a rising slope was applied to the scan electrodes Y1 to Yj by the set-up supplier 45, thereby applying a falling ramp waveform RPSD a slope of which is determined by a time constant value R2C to the third node n3. The falling ramp waveform RPSD generated at this time is applied, via the drive IC 42, to the scan electrode Y, thereby dropping a voltage on the scan electrode Y into a set-down voltage −Vsdw.

The Y driver 100 further includes a ninth switch Q9 connected between the third node n3 and the fourth node n4. The ninth switch Q9 plays a role to switch scan reference voltages Vscw and Vsce applied to the drive IC 42 in response to a control signal Dic_updn from the timing controller (not shown).

Figure 11:
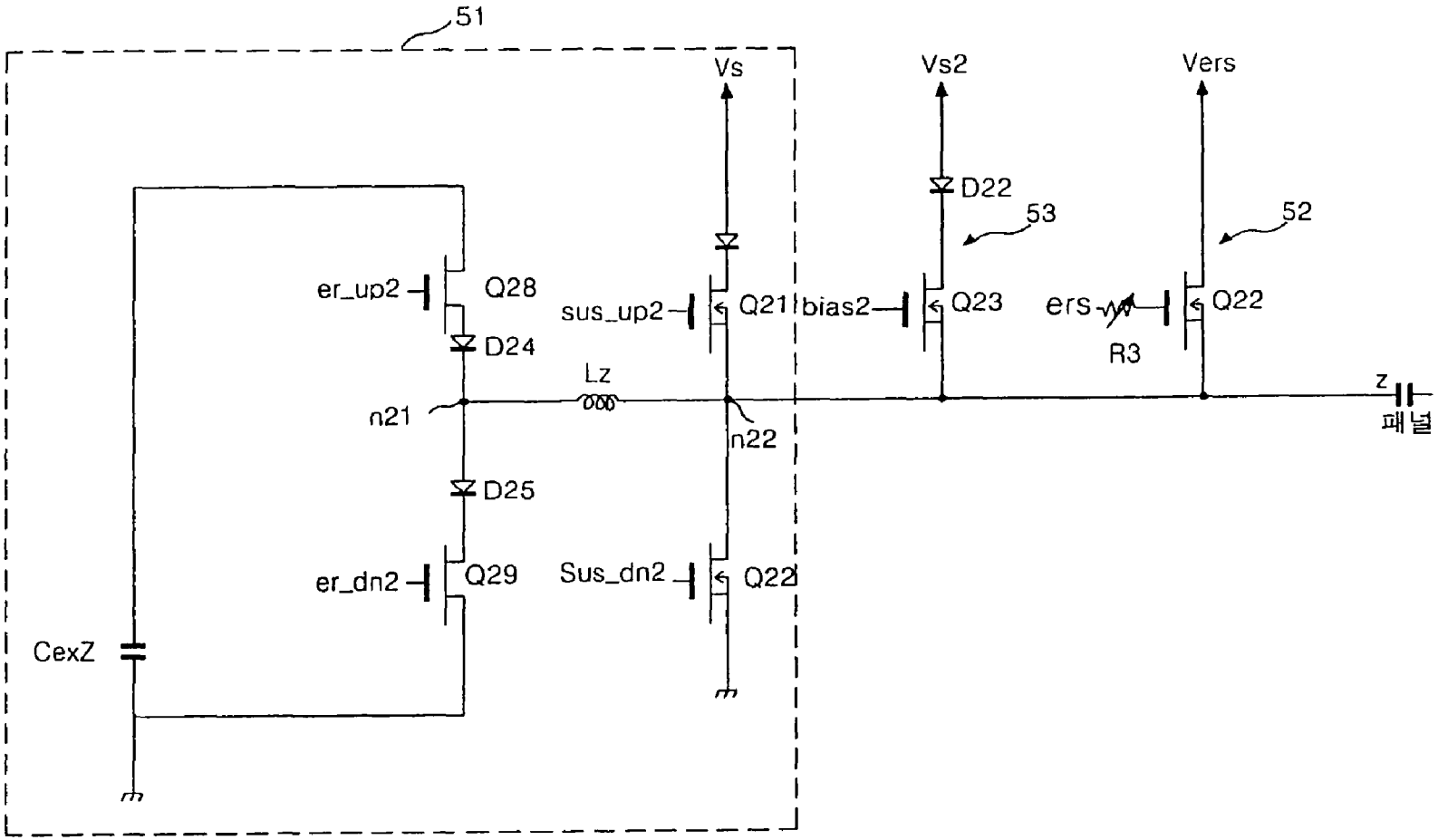
FIG. 11 is a detailed circuit diagram of the Z driver shown in FIG. 9.

FIG. 11 is a detailed circuit diagram of the Z driver 102.

Referring to FIG. 11, the Z driver 102 includes a DC bias voltage supply 53 and a post erasing signal supply 52 that are connected between an energy recovery circuit 51 and the sustain electrodes Z1 to Zj.

The energy recovery circuit 51 charges voltages of the sustain electrodes Z1 to Zm and recovers an energy from the sustain electrodes Z1 to Zj using a charged voltage of a external capacitor CexZ and an LC resonance like that of the Y driver 100, thereby charging the external capacitor CexZ. The energy recovery circuit 51 is comprised of an external capacitor CexZ for charging an energy recovered from the sustain electrodes Z1 to Zj, switches Q28 and Q39 connected, in parallel, to the external capacitor CexZ, an inductor Lz between the first node n21 and the second node n22, a switch Q21 connected between a sustain voltage source Vs and the second node n22, and a switch Q22 connected between the second node n22 and a ground voltage terminal GND. Reference numerals 'D23', 'D24' and 'D25' represent diodes for shutting off a reverse current. Such an energy recovery circuit is driven upon application of a sustain voltage Vs, a DC bias voltage Vzsc and a ramp voltage Vramp.

In the energy recovery circuit 51, the first switch Q21 is switched in response to a control signal sus_up2 from a timing controller (not shown), thereby keeping voltages on the sustain electrodes Z1 to Zi at the sustain voltage Vs after an LC resonance voltage was applied to the sustain electrodes Z1 to Zj. Furthermore, the first switch Q21 plays a role to keep the voltages on the sustain electrodes Z1 to Zj at the first DC bias voltage DCbias1 during a time period when a set-down pulse RPSD is applied to the scan electrodes Y1 to Yj. Since a function and a configuration of each element configuring the energy recovery circuit 51 other than the first switch Q1 are substantially identical to those of the Y driver 100, a detailed explanation as to them will be omitted.

The DC bias voltage supply 53 is comprised of a diode D22 and a switch Q23 that are connected between the second sustain voltage source Vs2 and the second node n22. The third switch Q23 is switched in response to a control signal bias2 from the timing controller (not shown) during the erasing address period of the selective erasing sub-field ESF, thereby applying a DC voltage lower than the sustain voltage to the sustain electrodes Z1 to Zj.

The post erasing signal supply 52 is comprised of a switch Q22 that is connected between an erasing voltage source Vers and the second node n22. The second switch Q22 is switched in response to a control signal ers from the timing controller (not shown) during the post erase period of the selective writing sub-field WSF, thereby applying a post erasing signal ERS a slope of which is determined by a time constant value R3C to the sustain electrodes Z1 to Zj.

In the Y driver 100 and the Z driver 102, pulse widths of the sustaining pulses WISUS1, WISUS2, NSUS1 to NSUS8 and WFSUS are controlled by ON-time of the switches Q1, Q4 and Q21.

Figure 12:
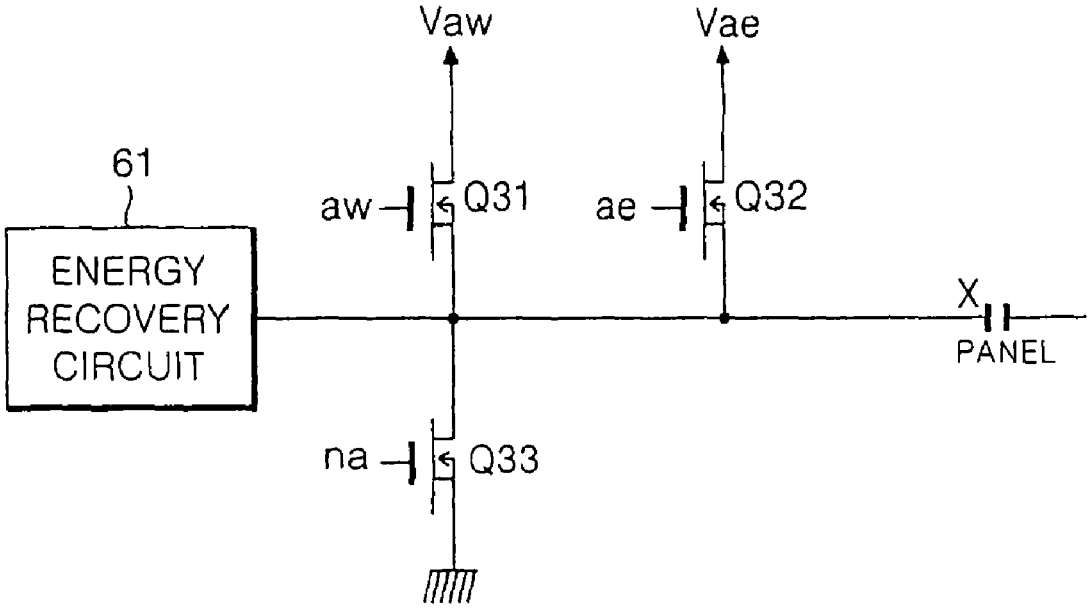
FIG. 12 is a detailed circuit diagram of the Z driver shown in FIG. 9.

FIG. 12 is a detailed circuit diagram of the X driver 104.

Referring to FIG. 12, the X driver includes an energy recovery circuit 61, the first switch Q31 connected between a writing data voltage source Vaw and address electrodes X1 to Xi, the second switch Q32 connected between an erasing data voltage source Vae and the address electrodes X1 to Xi, and a third switch Q33 connected between the address electrode X1 to Xi and a ground voltage source GND.

The energy recovery circuit 61 recovers an energy from the address electrodes X1 to Xi into an external capacitor (not shown) to thereby reduce a waste of data voltage. A configuration of the energy recovery circuit 61 is substantially identical to that 41 or 51 shown in FIG. 10 or FIG. 11.

The first switch Q31 is switched in response to a control signal aw from a timing controller (not shown) during the writing address period of the selective writing sub-field WSF, thereby applying a writing data voltage Vaw to the address electrodes X1 to Xi.

The second switch Q32 is switched in response to a control signal ae from the timing controller (not shown) during the writing address period of the selective erasing sub-field ESF, thereby applying an erasing data voltage Vae to the address electrodes X1 to Xi.

The third switch Q33 is switched in response to a control signal na from the timing controller (not shown) during a period when voltages on the address electrodes X1 to Xi must be kept at 0V or a ground voltage GND, that is, the reset period or the sustain period, thereby applying a ground voltage GND to the address electrodes X1 to Xi. Herein, the ground voltage GND may be set to 0V or a different voltage.

Alternatively, each switch shown in FIG. 10 to FIG. 12 may be configured into a plurality of switches depending upon a voltage characteristic and a current characteristic of the switch element.

As described above, according to the present invention, one frame is divided into sub-fields driven in the selective writing system and sub-fields driven in the selective erasing system without a full writing interval for the purpose of driving the plasma display. Accordingly, the address period is dramatically shortened in comparison with the selective writing system, so that it becomes possible to sufficiently assure a sustain period. Also, a high-speed driving is permitted, so that it becomes advantage to drive a high resolution of panel. Furthermore, according to the present invention, a time period when a discharge is generated in the non-display period is minimized, so that it becomes possible to enhance a contrast ratio, thereby improving a sharpness of the displayed picture.

In addition, according to the present invention, a scan voltage and/or a data voltage are set differently at the selective writing sub-fields and the selective erasing sub-fields having a different discharge characteristic, thereby enlarging a driving margin at both the selective writing sub-fields and the selective erasing sub-fields as well as permitting a stable operation at a high-temperature environment. Particularly, a pulse width of the last sustaining pulse at the previous sub-field for an initialization of the selective erasing sub-fields is set to be larger than that of the different normal sustaining pulse, thereby enlarging a driving margin upon selective erasure in a case of simultaneously performing the selective writing and the selective erasing as well as stabilizing an initialization for the selective erasing.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display using a plurality of selective writing sub-fields arranged within one frame period, the plasma display including a plurality of scan electrodes, a plurality of sustain electrodes and a plurality of address electrodes, the method comprising:

applying an initialization waveform to the scan electrodes in a reset period of one of the plurality of selective writing subfields, the initialization waveform including a rising waveform that increases to a setup voltage and a falling waveform that decreases to a set-down voltage;

applying an initialization sustain pulse to the scan electrodes in a sustain period of the one of the plurality of selective writing sub-fields;

applying sustain pulses to all cells to sustain a discharge of selected on-cells in the sustain period of the one of the selective writing sub-fields of the one frame, wherein the initialization sustain pulse has a pulse width greater than a pulse width of each of the sustain pulses or the initialization sustain pulse has a voltage greater than a sustain voltage of each of the sustain pulses;

applying a first direct current bias voltage to the sustain electrodes during the reset period of the one of the selective writing sub-fields;

applying a second direct current bias voltage to the sustain electrodes during an address period of the one of the selective writing sub-fields; and applying sustain pulses to the sustain electrodes during the sustain period of the one of the selective writing sub-fields.

2. The method as claimed in claim 1, wherein the setup voltage is greater than the sustain voltage of the sustain pulses.

3. The method as claimed in claim 1, wherein the setup voltage is approximately 200 volts to 240 volts.

4. The method as claimed in claim 1, wherein the sustain voltage is approximately 170 volts to 185 volts.

5. The method as claimed in claim 1, wherein a voltage of the first direct current bias voltage substantially corresponds to the sustain voltage of each of the sustain pulses applied to the sustain electrodes in the sustain period.

6. The method as claimed in claim 1, wherein a voltage of the second direct current bias voltage is less than the sustain voltage of each of the sustain pulses applied to the sustain electrode in the sustain period.

7. The method as claimed in claim 1, wherein an absolute value of the set-down voltage is less than an absolute value of a scan voltage of the one of the selective writing sub-fields.

8. The method as claimed in claim 1, wherein the set-down voltage is approximately −40 volts to −50 volts.

9. The method as claimed in claim 1, wherein a swing width voltage is a voltage from a scan voltage of the selective writing sub-field to a writing scan reference voltage, and wherein the scan voltage of the selective writing sub-field plus an absolute value of the swing width voltage is greater than 0 volts.

10. The method as claimed in claim 1, wherein a scan voltage of the one selective writing sub-field is approximately −40 volts to −70 volts.

11. The method as claimed in claim 1, wherein a swing width voltage is a voltage from a scan voltage of the selective writing sub-field to a writing scan reference voltage, and wherein the swing width voltage is approximately 100 volts to 130 volts.

12. The method as claimed in claim 1, further comprising applying a writing data pulse to the address electrodes in an address period of the one of the selective writing sub-fields.

13. The method as claimed in claim 12, wherein a voltage of the writing data pulse is approximately 45 volts to 80 volts.

14. The method as claimed in claim 12, wherein a width of the writing data pulse is approximately 1 μsec to 3 μsec.

15. The method as claimed in claim 1, further comprising applying a writing scan pulse to the scan electrodes in an address period of the one of the selective writing sub-fields.

16. The method as claimed in claim 15, wherein a width of the writing scan pulse is approximately 1 μsec to 3 μsec.

17. The method as claimed in claim 1, wherein the pulse width of the initialization sustain pulse in the sustain period of the one of the selective writing sub-fields is approximately 10 μsec to 50 μsec.

18. The method as claimed in claim 1, wherein a width of a last sustain pulse in the sustain period of the one of the selective writing sub-fields is approximately 20 μsec to 50 μsec.

19. The method as claimed in claim 1, wherein a last selective writing sub-field includes the reset period for initializing all the cells of the plasma display, an address period for selecting said on-cells and the sustain period for causing a sustain discharge with respect to said selected on-cells.

20. The method as claimed in claim 1, wherein the pulse width of said initialization sustain pulse is approximately 5 μsec to 50 μsec.

21. The method as claimed in claim 1, wherein the voltage of said initialization sustain pulse is approximately 170 volts to 250 volts.

22. A driving apparatus for a plasma display that uses a plurality of selective writing sub-fields within one frame period, the plasma display including a plurality of scan electrodes, a plurality of sustain electrodes and a plurality of address electrodes, the driving apparatus comprising:

a scan drive circuit to apply an initialization waveform to the scan electrodes in a reset period of one of a plurality of selective writing subfields, the initialization waveform including a rising waveform that increases to a setup voltage and a falling waveform that decreases to a set-down voltage, the scan drive circuit to select on-cells using a writing discharge at each of said plurality of selective writing sub-fields of the one frame period, and the scan drive circuit to apply sustain pulses to cells in a sustain period of the one of the selective writing sub-fields to sustain a discharge of said selected on-cells, and the scan drive circuit to apply an initialization sustain pulse to the scan electrodes in the sustain period of the one of selective writing sub-fields, the initialization sustain pulse having a pulse width greater than a pulse width of the sustain pulses or the initialization sustain pulse has a voltage greater than a sustain voltage of said sustain pulses, wherein an absolute value of the set-down voltage is less than an absolute value of a scan voltage of the one of the selective writing sub-fields.

23. The driving apparatus as claimed in claim 22, wherein the setup voltage is greater than a sustain voltage of the sustain pulses.

24. The driving apparatus as claimed in claim 22, further comprising a sustain drive circuit to apply a first direct current bias voltage to the sustain electrodes in the reset period, to apply a second direct current bias voltage to the sustain electrodes in an address period, and to apply sustain pulses to the sustain electrodes in the sustain period.

25. The driving apparatus as claimed in claim 24, wherein a voltage of the second direct current bias voltage is less than the sustain voltage value of each of the sustain pulses applied to the sustain electrode in the sustain period.

26. The driving apparatus as claimed in claim 22, further comprising an address drive circuit to apply a writing data pulse to the address electrodes in an address period, wherein a voltage of the writing data pulse is approximately 45 volts to 80 volts and a width of the writing data pulse is approximately 1 μsec to 3 μsec.

27. The driving apparatus as claimed in claim 22, wherein the scan drive circuit applies a writing scan pulse to the scan electrodes in an address period, wherein a width of the writing scan pulse is approximately 1 μsec to 3 μsec.

28. The driving apparatus as claimed in claim 22, wherein the pulse width of the initialization sustain pulse in the sustain period of the one of the selective writing sub-fields is approximately 10 μsec to 50 μsec.

29. The driving apparatus as claimed in claim 22, wherein a width of a last sustain pulse in the sustain period of the one of the selective writing sub-fields is approximately 20 μsec to 50 μsec.

30. The driving apparatus as claimed in claim 22, wherein the pulse width of said initialization sustain pulse is approximately 5 μsec to 50 μsec.

31. The driving apparatus as claimed in claim 22, wherein the voltage of said initialization sustain pulse is approximately 170 volts to 250 volts.

* * * * *